US009291966B2

(12) United States Patent
Shoji et al.

(10) Patent No.: US 9,291,966 B2
(45) Date of Patent: Mar. 22, 2016

(54) FIXING DEVICE AND IMAGE FORMING APPARATUS

(71) Applicants: Keitaro Shoji, Kanagawa (JP); Kenji Ishii, Kanagawa (JP); Hiromasa Takagi, Tokyo (JP); Takayuki Seki, Kanagawa (JP)

(72) Inventors: Keitaro Shoji, Kanagawa (JP); Kenji Ishii, Kanagawa (JP); Hiromasa Takagi, Tokyo (JP); Takayuki Seki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/467,341

(22) Filed: Aug. 25, 2014

(65) Prior Publication Data

US 2015/0055994 A1 Feb. 26, 2015

(30) Foreign Application Priority Data

Aug. 26, 2013 (JP) ..... 2013-174337
Jul. 14, 2014 (JP) ..... 2014-144095

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 2215/2035; G03G 15/2053
See application file for complete search history.

(56) References Cited

U.S. PATENT DOCUMENTS 4,949,096 A * 8/1990 Ogawa et al. ..... 346/25
5,043,763 A * 8/1991 Koh et al. ..... 399/335
5,091,752 A * 2/1992 Okada ..... 399/329
5,262,834 A * 11/1993 Kusaka et al. ..... 399/329
5,278,618 A * 1/1994 Mitani et al. ..... 399/329
5,319,425 A * 6/1994 Forlani ..... 399/328
5,376,773 A * 12/1994 Masuda et al. ..... 219/543
5,499,087 A * 3/1996 Hiraoka et al. ..... 399/329
5,753,889 A * 5/1998 Kondo et al. ..... 219/216
5,999,788 A * 12/1999 Kanesawa et al. ..... 399/329
6,456,819 B1 * 9/2002 Abe et al. ..... 399/329
6,947,699 B2 * 9/2005 Suzuki et al. ..... 399/329

(Continued)

FOREIGN PATENT DOCUMENTS

JP 11-260533 9/1999
JP 2001-324886 11/2001

(Continued)

OTHER PUBLICATIONS

Machinie translation of JP 2010-032625.*

(Continued)

*Primary Examiner* — David Bolduc
(74) *Attorney, Agent, or Firm* — Oblon, McClelland, Maier & Neustadt, L.L.P.

(57) ABSTRACT

A fixing device includes a fixing rotator rotatable in a predetermined direction of rotation and an opposed rotator disposed opposite the fixing rotator to form a fixing nip therebetween through which a recording medium bearing a toner image is conveyed. A heater is disposed opposite the fixing rotator to heat the fixing rotator. A nip formation pad is disposed opposite an inner circumferential surface of the fixing rotator. The nip formation pad includes a base, a first thermal conductor sandwiched between the base and the fixing rotator and having a first thermal conductivity greater than a thermal conductivity of the base, and a bulge projecting from the first thermal conductor toward the opposed rotator at a downstream end of the first thermal conductor in a recording medium conveyance direction.

31 Claims, 16 Drawing Sheets

(56) References Cited

U.S. PATENT DOCUMENTS

| | | | | |
|---|---|---|---|---|
| 7,010,256 | B2 * | 3/2006 | Usui et al. | 399/328 |
| 7,107,000 | B2 * | 9/2006 | Watanabe et al. | 399/328 |
| 7,206,541 | B2 * | 4/2007 | Fukita et al. | 399/328 |
| 8,559,861 | B2 * | 10/2013 | Lee et al. | 399/329 |
| 2003/0077092 | A1 * | 4/2003 | Ogawa et al. | 399/328 |
| 2004/0184850 | A1 * | 9/2004 | Yoneda et al. | 399/329 |
| 2005/0191071 | A1 * | 9/2005 | Katayanagi et al. | 399/45 |
| 2006/0067754 | A1 * | 3/2006 | Gilmore et al. | 399/333 |
| 2010/0092221 | A1 * | 4/2010 | Shinshi et al. | 399/330 |
| 2010/0158587 | A1 | 6/2010 | Shin | |
| 2011/0070006 | A1 * | 3/2011 | Sone et al. | 399/333 |
| 2011/0129268 | A1 * | 6/2011 | Ishii et al. | 399/333 |
| 2011/0158715 | A1 * | 6/2011 | Suzuki et al. | 399/329 |
| 2011/0206406 | A1 * | 8/2011 | Suzuki et al. | 399/90 |
| 2011/0222875 | A1 * | 9/2011 | Imada et al. | 399/33 |
| 2011/0222931 | A1 * | 9/2011 | Shinshi et al. | 399/329 |
| 2011/0305473 | A1 * | 12/2011 | Tamaki | 399/67 |
| 2012/0155935 | A1 * | 6/2012 | Yoshikawa et al. | 399/329 |
| 2012/0224895 | A1 * | 9/2012 | Baba et al. | 399/329 |
| 2012/0269560 | A1 * | 10/2012 | Sakakibara | 399/335 |
| 2012/0275833 | A1 * | 11/2012 | Ishida et al. | 399/329 |
| 2013/0170880 | A1 * | 7/2013 | Gotoh et al. | 399/329 |
| 2013/0177340 | A1 * | 7/2013 | Kawata et al. | 399/329 |
| 2013/0209146 | A1 * | 8/2013 | Yamaji et al. | 399/329 |
| 2013/0216282 | A1 * | 8/2013 | Ohtsu | 399/329 |
| 2013/0279955 | A1 * | 10/2013 | Maeda | 399/329 |
| 2013/0308990 | A1 * | 11/2013 | Samei et al. | 399/329 |
| 2014/0064803 | A1 * | 3/2014 | Okabayashi et al. | 399/329 |

FOREIGN PATENT DOCUMENTS

| | | | | |
|---|---|---|---|---|
| JP | 2002268424 A | * | 9/2002 | G03G 15/20 |
| JP | 2010-032625 | | 2/2010 | |

OTHER PUBLICATIONS

U.S. Appl. No. 14/207,748, filed Mar. 13, 2014.

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2013-174337, filed on Aug. 26, 2013, and 2014-144095, filed on Jul. 14, 2014, in the Japanese Patent Office, the entire disclosure of each of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator such as a fixing belt, a fixing film, and a fixing roller heated by a heater and an opposed rotator such as a pressure roller and a pressure belt pressed against the fixing rotator to form a fixing nip therebetween. As a recording medium bearing a toner image is conveyed through the fixing nip, the fixing rotator and the opposed rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and an opposed rotator disposed opposite the fixing rotator to form a fixing nip therebetween through which a recording medium bearing a toner image is conveyed. A heater is disposed opposite the fixing rotator to heat the fixing rotator. A nip formation pad is disposed opposite an inner circumferential surface of the fixing rotator. The nip formation pad includes a base, a first thermal conductor sandwiched between the base and the fixing rotator and having a first thermal conductivity greater than a thermal conductivity of the base, and a bulge projecting from the first thermal conductor toward the opposed rotator at a downstream end of the first thermal conductor in a recording medium conveyance direction.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes a fixing rotator rotatable in a predetermined direction of rotation and an opposed rotator disposed opposite the fixing rotator to form a fixing nip therebetween through which the recording medium bearing the toner image is conveyed. A heater is disposed opposite the fixing rotator to heat the fixing rotator. A nip formation pad is disposed opposite an inner circumferential surface of the fixing rotator. The nip formation pad includes a base, a first thermal conductor sandwiched between the base and the fixing rotator and having a first thermal conductivity greater than a thermal conductivity of the base, and a bulge projecting from the first thermal conductor toward the opposed rotator at a downstream end of the first thermal conductor in a recording medium conveyance direction.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
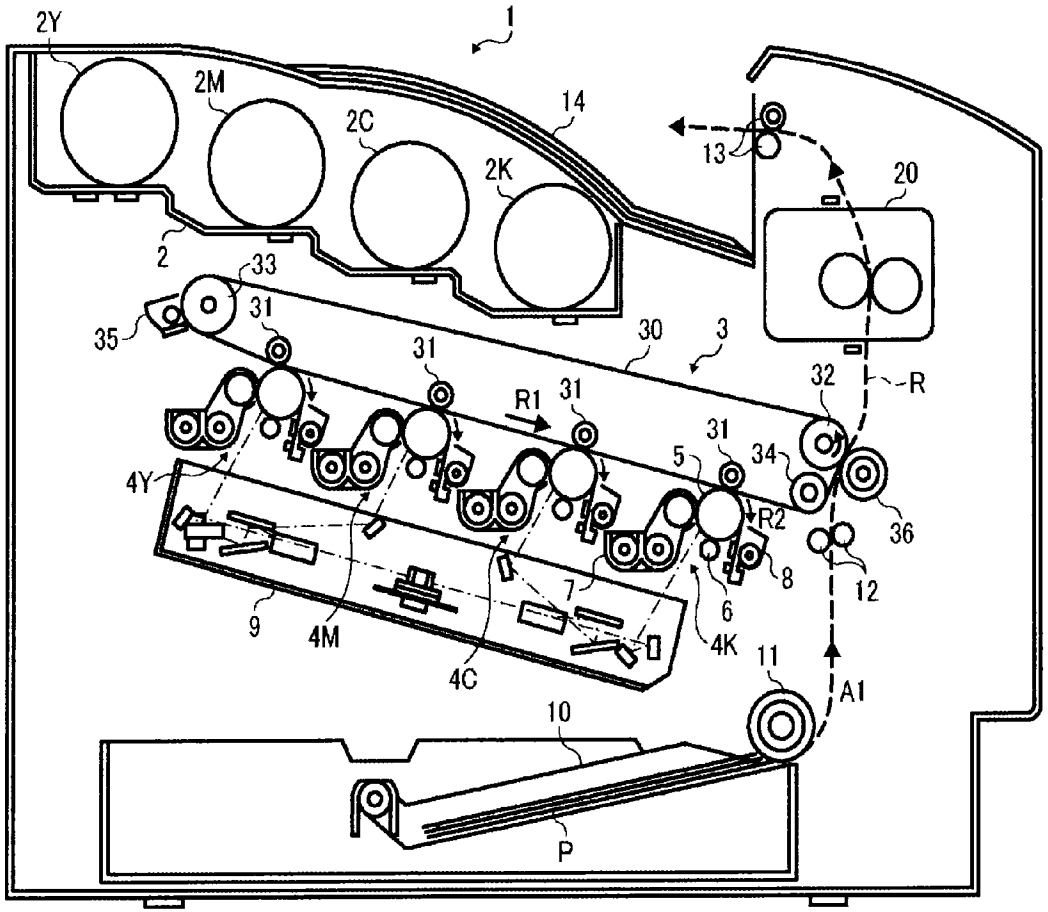
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

With reference to FIG. 1, a description is provided of a construction of the image forming apparatus 1.

As shown in FIG. 1, the image forming apparatus 1 includes four image forming devices 4Y, 4M, 4C, and 4K situated in a center portion thereof. Although the image forming devices 4Y, 4M, 4C, and 4K contain yellow, magenta, cyan, and black developers (e.g., yellow, magenta, cyan, and black toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction A1. The registration roller pair 12 serving as a conveyance roller pair or a timing roller pair feeds the sheet P conveyed from the feed roller 11 toward the secondary transfer nip at a proper time.

The conveyance path R is further provided with a fixing device 20 located above the secondary transfer nip, that is, downstream from the secondary transfer nip in the sheet conveyance direction A1. The fixing device 20 fixes a toner image transferred from the intermediate transfer belt 30 onto the sheet P conveyed from the secondary transfer nip. The conveyance path R is further provided with the output roller pair 13 located above the fixing device 20, that is, downstream from the fixing device 20 in the sheet conveyance direction A1. The output roller pair 13 discharges the sheet P bearing the fixed toner image onto the outside of the image forming apparatus 1, that is, an output tray 14 disposed atop the image forming apparatus 1. The output tray 14 stocks the sheet P discharged by the output roller pair 13.

With reference to FIG. 1, a description is provided of an image forming operation performed by the image forming apparatus 1 having the construction described above to form a color toner image on a sheet P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the charged toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

As the yellow, magenta, cyan, and black toner images constituting the color toner image on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images from the intermediate transfer belt 30 onto the sheet P collectively. After the secondary transfer of the color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into the waste toner container.

Thereafter, the sheet P bearing the color toner image is conveyed to the fixing device 20 that fixes the color toner image on the sheet P. Then, the sheet P bearing the fixed color toner image is discharged by the output roller pair 13 onto the outside of the image forming apparatus 1, that is, the output tray 14 that stocks the sheet P.

The above describes the image forming operation of the image forming apparatus 1 to form the color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
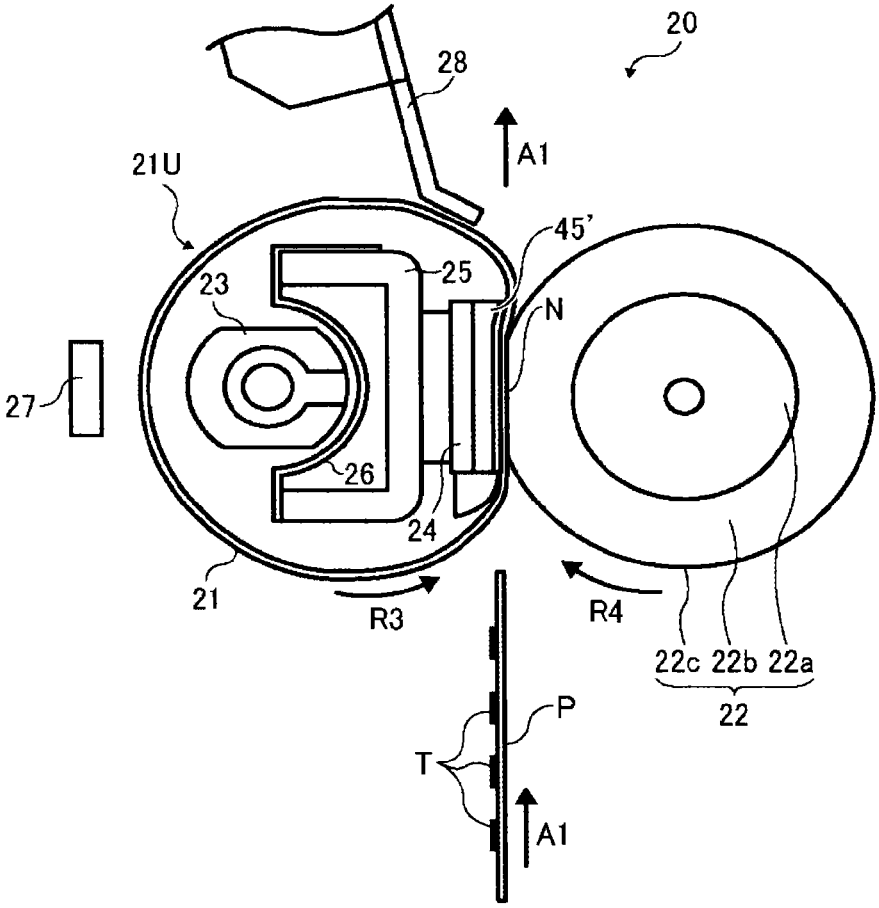
FIG. 2 is a vertical sectional view of a fixing device incorporated in the image forming apparatus shown in FIG. 1.

With reference to FIG. 2, a description is provided of a construction of the fixing device 20 incorporated in the image forming apparatus 1 described above.

FIG. 2 is a vertical sectional view of the fixing device 20. As shown in FIG. 2, the fixing device 20 (e.g., a fuser) includes a fixing belt 21 serving as a fixing rotator or an endless belt formed into a loop and rotatable in a rotation direction R3; a pressure roller 22 serving as an opposed rotator disposed opposite an outer circumferential surface of the fixing belt 21 to separably or unseparably contact the fixing belt 21 and rotatable in a rotation direction R4 counter to the rotation direction R3 of the fixing belt 21; a single halogen heater 23 serving as a heater disposed inside the loop formed by the fixing belt 21 to heat the fixing belt 21; a nip formation pad 24 disposed inside the loop formed by the fixing belt 21 and pressing against the pressure roller 22 via the fixing belt 21 to form a fixing nip N between the fixing belt 21 and the pressure roller 22; a stay 25 serving as a support disposed inside the loop formed by the fixing belt 21 and contacting and supporting the nip formation pad 24; a reflector 26 disposed inside the loop formed by the fixing belt 21 to reflect light radiated from the halogen heater 23 toward the fixing belt 21; a temperature sensor 27 serving as a temperature detector disposed opposite the outer circumferential surface of the fixing belt 21 to detect the temperature of the fixing belt 21; and a separator 28 disposed opposite the outer circumferential surface of the fixing belt 21 to separate a sheet P discharged from the fixing nip N from the fixing belt 21.

The fixing device 20 further includes a pressurization assembly that presses the pressure roller 22 against the nip formation pad 24 via the fixing belt 21. The fixing belt 21 and the components disposed inside the loop formed by the fixing belt 21, that is, the halogen heater 23, the nip formation pad 24, the stay 25, and the reflector 26, may constitute a belt unit 21U separably coupled with the pressure roller 22.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer made of rubber such as silicone rubber, silicone rubber foam, and fluoro rubber may be interposed between the base layer and the release layer.

A detailed description is now given of a construction of the pressure roller 22.

The pressure roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. The pressurization assembly presses the pressure roller 22 against the nip formation pad 24 via the fixing belt 21. Thus, the pressure roller 22 pressingly contacting the fixing belt 21 deforms the elastic layer 22*b* of the pressure roller 22 at the fixing nip N formed between the pressure roller 22 and the fixing belt 21, thus creating the fixing nip N having a predetermined length in the sheet conveyance direction A1. A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21.

As shown in FIG. 2, according to this exemplary embodiment, the pressure roller 22 is a solid roller. Alternatively, the pressure roller 22 may be a hollow roller. In this case, a heater such as a halogen heater may be disposed inside the hollow roller. If the hollow pressure roller does not incorporate the elastic layer, the pressure roller has a decreased thermal capacity that improves fixing property of being heated quickly to a predetermined fixing temperature at which a toner image T is fixed on a sheet P properly. However, as the pressure roller and the fixing belt 21 sandwich and press the toner image T on the sheet P passing through the fixing nip N, slight surface asperities of the fixing belt 21 may be transferred onto the toner image T on the sheet P, resulting in variation in gloss of the solid toner image T. To address this problem, it is preferable that the pressure roller incorporates the elastic layer having a thickness not smaller than about 100 micrometers. The elastic layer having the thickness not smaller than about 100 micrometers elastically deforms to absorb slight surface asperities of the fixing belt 21, preventing variation in gloss of the toner image T on the sheet P. The elastic layer 22*b* may be made of solid rubber. Alternatively, if no heater is situated inside the pressure roller 22, the elastic layer 22*b* may be made of sponge rubber. The sponge rubber is more preferable than the solid rubber because it has an increased insulation that draws less heat from the fixing belt 21. According to this exemplary embodiment, the pressure roller 22 is pressed against the fixing belt 21. Alternatively, the pressure roller 22 may merely contact the fixing belt 21 with no pressure therebetween.

A detailed description is now given of a configuration of the halogen heater 23.

Both lateral ends of the halogen heater 23 in a longitudinal direction thereof parallel to an axial direction of the fixing belt 21 are mounted on side plates of the fixing device 20, respectively. The power supply situated inside the image forming apparatus 1 supplies power to the halogen heater 23 so that the halogen heater 23 heats the fixing belt 21. A controller (e.g., a processor), that is, a central processing unit (CPU) provided with a random-access memory (RAM) and a read-only memory (ROM), for example, operatively connected to the halogen heater 23 and the temperature sensor 27 controls the halogen heater 23 based on the temperature of the outer circumferential surface of the fixing belt 21 detected by the temperature sensor 27 so as to adjust the temperature of the fixing belt 21 to a desired fixing temperature. Alternatively, instead of the halogen heater 23, an induction heater, a resistance heat generator, a carbon heater, or the like may be employed as a heater that heats the fixing belt 21.

A detailed description is now given of a configuration of the nip formation pad 24.

The nip formation pad 24 extends in the axial direction of the fixing belt 21 or the pressure roller 22 such that a longitudinal direction of the nip formation pad 24 is parallel to the axial direction of the fixing belt 21 or the pressure roller 22. The nip formation pad 24 is mounted on and supported by the stay 25. Accordingly, even if the nip formation pad 24 receives pressure from the pressure roller 22, the nip formation pad 24 is not bent by the pressure and therefore produces a uniform nip width throughout the entire span of the pressure roller 22 in the axial direction thereof. The stay 25 is made of metal having an increased mechanical strength, such as stainless steel and iron, to prevent bending of the nip formation pad 24. Alternatively, the stay 25 may be made of resin.

The nip formation pad 24 is made of a heat resistant material resistant against temperatures not lower than about 200 degrees centigrade. Thus, the nip formation pad 24 is immune from thermal deformation at temperatures in a fixing temperature range desirable to fix the toner image T on the sheet P, retaining the shape of the fixing nip N and quality of the toner image T formed on the sheet P. For example, the nip formation pad 24 is made of general heat resistant resin such as polyether sulfone (PES), polyphenylene sulfide (PPS), liquid crystal polymer (LCP), polyether nitrile (PEN), polyamide imide (PAI), and polyether ether ketone (PEEK). According to this exemplary embodiment, the nip formation pad 24 is made of LCP TI-8000 available from Toray Industries, Inc.

The nip formation pad 24 is coated with a low-friction sheet serving as a slide aid. As the fixing belt 21 rotates in the rotation direction R3, the fixing belt 21 slides over the low-friction sheet that reduces a driving torque developed between the fixing belt 21 and the nip formation pad 24, reducing load exerted to the fixing belt 21 by friction between the fixing belt 21 and the nip formation pad 24. For example, the low-friction sheet is made of TOYOFLON® 401 available from Toray Industries, Inc.

A detailed description is now given of a configuration of the reflector 26.

The reflector 26 is interposed between the stay 25 and the halogen heater 23. According to this exemplary embodiment, the reflector 26 is mounted on the stay 25. Since the reflector 26 is heated by the halogen heater 23 directly, the reflector 26 is made of metal having a high melting point. The reflector 26 reflects light radiated from the halogen heater 23 to the stay 25 toward the fixing belt 21, increasing an amount of light that irradiates the fixing belt 21 and thereby heating the fixing belt 21 effectively. Additionally, the reflector 26 suppresses conduction of heat from the halogen heater 23 to the stay 25 or the like, saving energy.

Alternatively, instead of installation of the reflector 26, an opposed face of the stay 25 disposed opposite the halogen heater 23 may be treated with polishing or mirror finishing such as coating to produce a reflection face that reflects light from the halogen heater 23 toward the fixing belt 21. For example, the reflector 26 or the reflection face of the stay 25 has a reflection rate of about 90 percent or more.

Since the shape and the material of the stay 25 are not selectable flexibly to retain the mechanical strength, if the reflector 26 is installed in the fixing device 20, the reflector 26 and the stay 25 provide flexibility in the shape and the material, attaining properties peculiar to them, respectively. The reflector 26 interposed between the halogen heater 23 and the stay 25 is situated in proximity to the halogen heater 23, reflecting light from the halogen heater 23 toward the fixing belt 21 effectively.

In order to save energy and decrease a first print time taken to output the sheet P bearing the fixed toner image T upon receipt of a print job through preparation for a print operation and the subsequent print operation, the fixing device 20 is configured as below. For example, the fixing device 20 employs a direct heating method in which the halogen heater 23 heats the fixing belt 21 directly in a circumferential span of the fixing belt 21 other than the fixing nip N. As shown in FIG. 2, no component is interposed between the halogen heater 23 and the fixing belt 21 in a circumferential, direct heating span of the fixing belt 21 on the left of the halogen heater 23 where the halogen heater 23 heats the fixing belt 21 directly.

In order to decrease the thermal capacity of the fixing belt 21, the fixing belt 21 is thin and has a decreased loop diameter. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 21 has a total thickness not greater than about 1 mm. A loop diameter of the fixing belt 21 is in a range of from about 20 mm to about 40 mm. In order to decrease the thermal capacity of the fixing belt 21 further, the fixing belt 21 may have a total thickness not greater than about 0.20 mm and preferably not greater than about 0.16 mm. Additionally, the loop diameter of the fixing belt 21 may not be greater than about 30 mm.

According to this exemplary embodiment, the pressure roller 22 has a diameter in a range of from about 20 mm to about 40 mm. Hence, the loop diameter of the fixing belt 21 is equivalent to the diameter of the pressure roller 22. However, the loop diameter of the fixing belt 21 and the diameter of the pressure roller 22 are not limited to the sizes described above. For example, the loop diameter of the fixing belt 21 may be smaller than the diameter of the pressure roller 22. In this case, a curvature of the fixing belt 21 is greater than a curvature of the pressure roller 22 at the fixing nip N, facilitating separation of the sheet P from the fixing belt 21 as it is discharged from the fixing nip N.

As shown in FIG. 2, a bulge 45' projects from the nip formation pad 24 toward the pressure roller 22 at a downstream end of the nip formation pad 24 in the sheet conveyance direction A1 disposed opposite an exit of the fixing nip N. The bulge 45' does not press against the pressure roller 22 via the fixing belt 21 and therefore is not produced by indirect contact with the pressure roller 22 via the fixing belt 21. The bulge 45' lifts the sheet P bearing the toner image T fixed at the fixing nip N from the fixing belt 21, facilitating separation of the sheet P from the fixing belt 21.

Since the fixing belt 21 has a decreased thermal capacity, it is susceptible to uneven temperature in the axial direction thereof as described below. As a small sheet P bearing a toner image T is conveyed through the fixing nip N, the small sheet P creates a conveyance span on the fixing belt 21 where the small sheet P is conveyed over the fixing belt 21 at a center of the fixing belt 21 in the axial direction thereof and a non-conveyance span on the fixing belt 21 where the small sheet P is not conveyed over the fixing belt 21 at each lateral end of the fixing belt 21 in the axial direction thereof. The sheet P and the toner image T thereon draw heat from the conveyance span of the fixing belt 21 but do not draw heat from the non-conveyance span of the fixing belt 21. Accordingly, the non-conveyance span of the fixing belt 21 may store heat and overheat to a temperature higher than a predetermined temperature (e.g., the fixing temperature at which the toner image T is fixed on the sheet P properly). Such overheating may also occur on a fixing roller used as a fixing rotator instead of the fixing belt 21.

To address this circumstance, a heat shield may surround the nip formation pad 24 to shield the nip formation pad 24 from the halogen heater 23.

However, since the nip formation pad 24 is made of a material having an increased thermal conductivity, the nip formation pad 24 may absorb heat excessively. For example, when the heat shield is cool during warm-up of the fixing device 20, the conductive nip formation pad 24 may absorb heat from the fixing belt 21 excessively, increasing energy consumption. Conversely, when the heat shield is heated, the heat shield may cause overheating of both lateral ends of the fixing belt 21 in the axial direction thereof.

Figure 3:
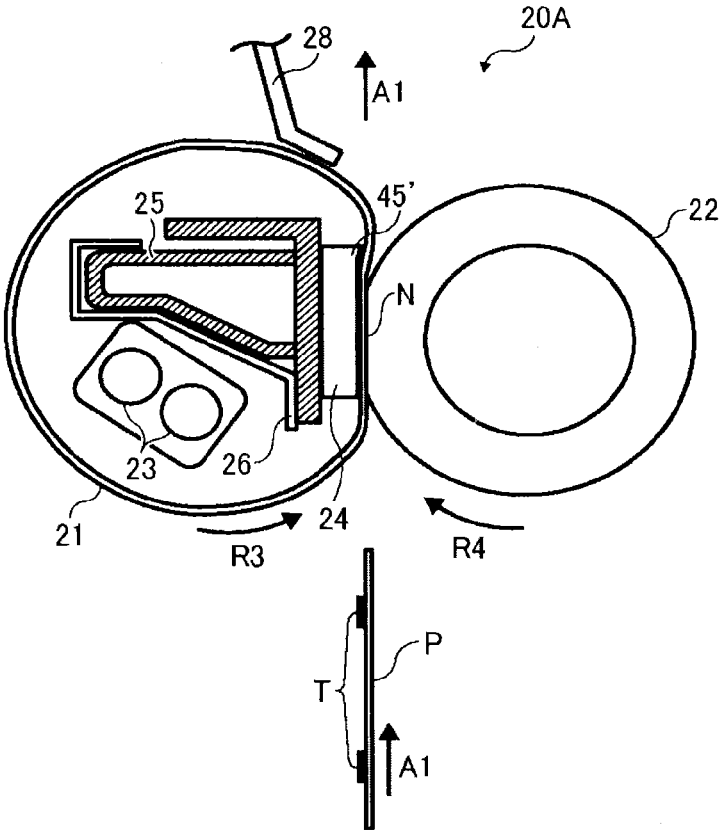
FIG. 3 is a vertical sectional view of an alternative fixing device installable in the image forming apparatus shown in FIG. 1.

With reference to FIG. 3, a description is provided of a configuration of a fixing device 20A installable in the image forming apparatus 1 depicted in FIG. 1.

FIG. 3 is a schematic vertical sectional view of the fixing device 20A. As shown in FIG. 3, the fixing device 20A includes two halogen heaters 23 serving as a heater situated inside the loop formed by the fixing belt 21. The halogen heaters 23 generate light that irradiates the inner circumferential surface of the fixing belt 21, heating the fixing belt 21 directly. Like the fixing device 20 depicted in FIG. 2, the fixing device 20A includes the bulge 45' that projects from the nip formation pad 24 toward the pressure roller 22 at the downstream end of the nip formation pad 24 in the sheet conveyance direction A1 disposed opposite the exit of the fixing nip N. The bulge 45' does not press against the pressure roller 22 via the fixing belt 21 and therefore is not produced by indirect contact with the pressure roller 22 via the fixing belt 21. The bulge 45' lifts a sheet P bearing a toner image T fixed at the fixing nip N from the fixing belt 21, facilitating separation of the sheet P from the fixing belt 21.

With reference to FIGS. 4, 5A, 5B, and 5C, a description is provided of a configuration of a comparative fixing device 20C that suffers from overheating of both lateral ends of the fixing belt 21 in the axial direction thereof.

Figure 4:
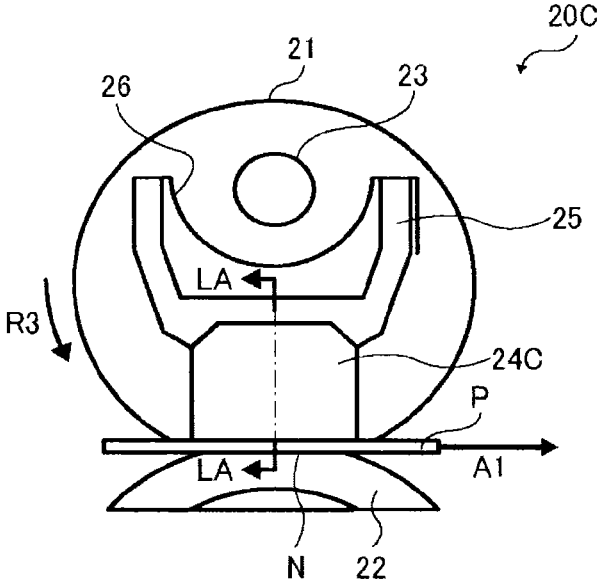
FIG. 4 is a partial schematic vertical sectional view of a comparative fixing device.

FIG. 4 is a partial schematic vertical sectional view of the comparative fixing device 20C. In the comparative fixing device 20C, heat conducted from the halogen heater 23 to the fixing belt 21 is further conducted from the fixing belt 21 to the medium and the components that contact the fixing belt 21. For example, heat is conducted from the outer circumferential surface of the fixing belt 21 to the pressure roller 22 that contacts the outer circumferential surface of the fixing belt 21 and to the sheet P and toner of the toner image T on the sheet P as the sheet P is conveyed through the fixing nip N. Heat is conducted from the inner circumferential surface of the fixing belt 21 to a nip formation pad 24C that contacts the inner circumferential surface of the fixing belt 21. The nip formation pad 24C is made of resin having a decreased thermal conductivity and therefore draws a decreased amount of heat from the fixing belt 21. Accordingly, as a plurality of small sheets P having a decreased width in the axial direction of the fixing belt 21 is conveyed through the fixing nip N continuously, the fixing belt 21 stores heat at both lateral ends in the axial direction thereof, that is, a non-conveyance span, where the small sheets P are not conveyed over the fixing belt 21 and therefore do not draw heat from the fixing belt 21. Consequently, the fixing belt 21 suffers from overheating in the non-conveyance span as the small sheets P having the decreased width that is smaller than a light emission span H of the halogen heater 23 spanning in the longitudinal direction thereof are conveyed through the fixing nip N continuously.

Figure 5A:
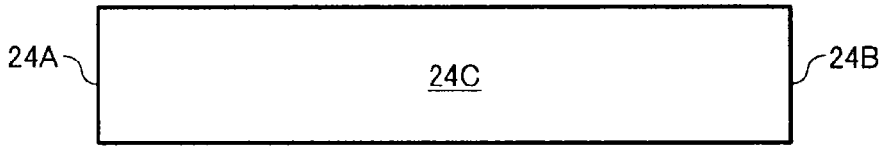
FIG. 5A is a sectional view of a nip formation pad incorporated in the comparative fixing device shown in FIG. 4 taken along line LA-LA in FIG. 4.

FIG. 5A is a sectional view of the nip formation pad 24C taken along line LA-LA in FIG. 4. It is to be noted that FIG. 5A illustrates a half of the nip formation pad 24C in a longitudinal direction thereof parallel to the axial direction of the fixing belt 21, from a center 24A to a lateral edge 24B of the nip formation pad 24C in the longitudinal direction thereof.

Figure 5B:
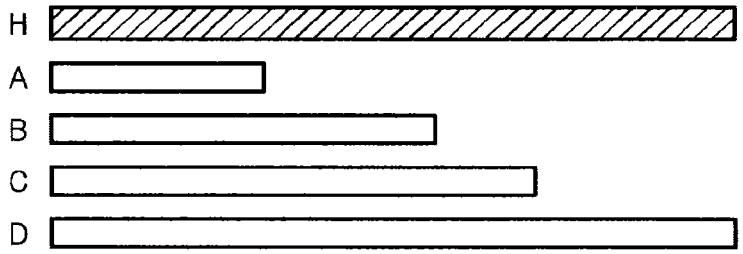
FIG. 5B is a diagram illustrating positional relations between a light emission span of a halogen heater incorporated in the comparative fixing device shown in FIG. 4 and four conveyance spans of sheets conveyed through the comparative fixing device.

FIG. 5B is a diagram illustrating positional relations between the light emission span H of the halogen heater 23 and four conveyance spans A, B, C, and D of sheets P of four sizes in the longitudinal direction of the halogen heater 23 parallel to the axial direction of the fixing belt 21. The halogen heater 23 of the comparative fixing device 20C is constructed of a single heater extending in a longitudinal direction thereof parallel to the axial direction of the fixing belt 21.

Figure 5C:
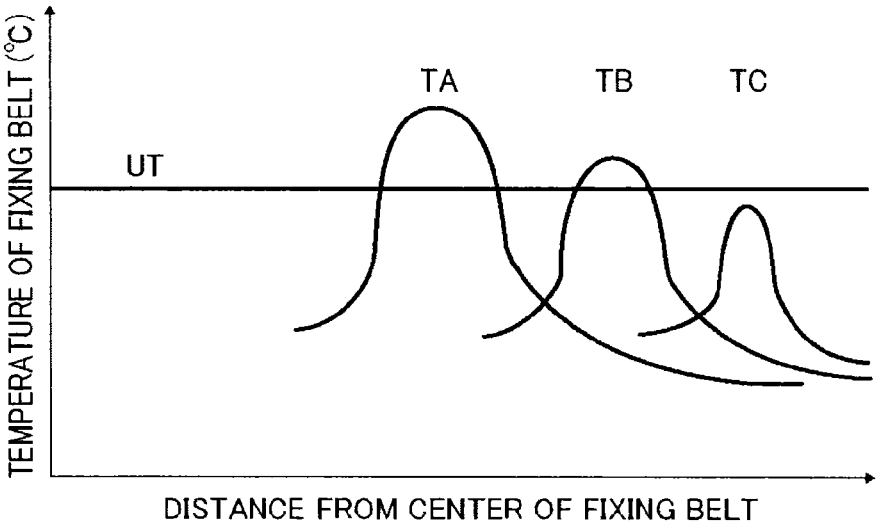
FIG. 5C is a graph showing a relation between the distance from a center of a fixing belt incorporated in the comparative fixing device shown in FIG. 4 and the temperature of the fixing belt.

FIG. 5C is a graph showing a relation between the distance from a center of the fixing belt 21 in the axial direction thereof and the temperature of the fixing belt 21 in a non-conveyance span outboard from the conveyance spans A, B, C, and D in the axial direction of the fixing belt 21 as sheets P of four sizes are conveyed over the fixing belt 21. FIG. 5C illustrates temperatures TA, TB, and TC in the non-conveyance span, that is, a lateral end of the fixing belt 21 in the axial direction thereof, where the sheet P is not conveyed over the fixing belt 21.

For instance, when a plurality of sheets P having the smallest width is conveyed over the smallest conveyance span A of the fixing belt 21 continuously, the temperature TA of the fixing belt 21 increases in the greatest non-conveyance span outboard from the smallest conveyance span A in the axial direction of the fixing belt 21. However, since the temperature of the halogen heater 23 increases to an increased temperature at a center in the longitudinal direction thereof whereas the temperature of the halogen heater 23 increases to a decreased temperature at a lateral end in the longitudinal direction thereof, the temperature TA of the fixing belt 21 marks a peak at a position outboard from the conveyance span A and decreases gently toward a lateral edge of the fixing belt 21 in the axial direction thereof. Contrarily, when a sheet P having the greatest width is conveyed over the greatest conveyance span D of the fixing belt 21, the sheet P having the greatest width does not produce the non-conveyance span on the fixing belt 21 as it is conveyed over the fixing belt 21. Hence, the temperature of the fixing belt 21 may barely increase in the non-conveyance span situated at the lateral end of the fixing belt 21 in the axial direction thereof.

If the diameter, the linear velocity, and the productivity of the fixing belt 21 and the pressure roller 22 are fixed, as the size of the non-conveyance span on the fixing belt 21 that defines a difference between the light emission span H of the halogen heater 23 and each of the conveyance spans A, B, C, and D increases, an amount of heat stored in the fixing belt 21 increases, thus increasing overheating of the lateral end of the fixing belt 21 and producing the temperature TA that is higher than the temperature TB higher than the temperature TC. As a result of overheating of the fixing belt 21, the temperatures TA and TB may be above an upper limit of target temperature UT of the fixing belt 21 and the temperature TC may be below the upper limit of target temperature UT of the fixing belt 21.

With reference to FIGS. 6, 7A, 7B, 8A, 8B, and 8C, a description is provided of a configuration of the fixing device 20 according to an exemplary embodiment.

Figure 6:
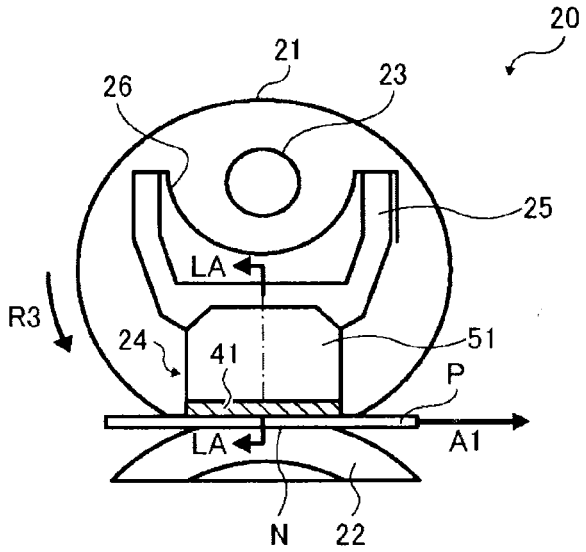
FIG. 6 is a partial schematic vertical sectional view of a fixing device according to a first exemplary embodiment.

FIG. 6 is a partial schematic vertical sectional view of the fixing device 20. A typical fixing device, for example, the comparative fixing device 20C depicted in FIG. 4, includes the nip formation pad 24C made of resin as a base and contacting the fixing belt 21. The nip formation pad 24C is coated with a low-friction sheet serving as a slide aid. Contrarily, the fixing device 20 shown in FIG. 6 includes the nip formation pad 24 including a base 51 and an equalizer 41 serving as a first thermal conductor sandwiched between the base 51 and the fixing belt 21 at the fixing nip N and extended in a longitudinal direction thereof parallel to the axial direction of the fixing belt 21. The equalizer 41 is made of a material having a thermal conductivity greater than that of the base 51 to absorb excessive heat stored in the non-conveyance span of the fixing belt 21 and conduct the absorbed heat in the longitudinal direction of the equalizer 41.

The nip formation pad 24 is not coated with the low-friction sheet so as to enhance heat absorption from the fixing belt 21. However, if the equalizer 41 absorbs heat from the fixing belt 21 excessively or if friction between the equalizer 41 and the fixing belt 21 produces a torque that obstructs rotation of the fixing belt 21, the low-friction sheet may coat the equalizer 41. As the sheet P is conveyed over the fixing belt 21, the sheet P draws heat from the equalizer 41. Accordingly, heat conducts to a relatively cooler center of the equalizer 41 in the longitudinal direction thereof or a cooler portion of each lateral end of the equalizer 41 in the longitudinal direction thereof that is susceptible to overheating.

Figure 7A:
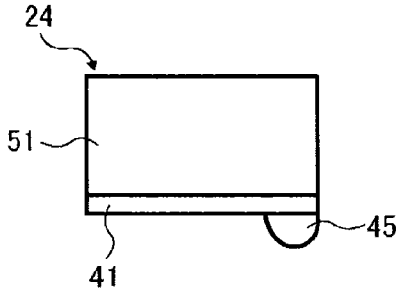
FIG. 7A is a schematic sectional view of a nip formation pad incorporated in the fixing device shown in FIG. 6.

FIG. 7A is a schematic sectional view of the nip formation pad 24. As shown in FIG. 7A, the base 51 is mounted on the equalizer 41 in a thickness direction thereof perpendicular to the sheet conveyance direction A1 such that a length of the equalizer 41 is equivalent to a length of the base 51 in the sheet conveyance direction A1.

Figure 7B:
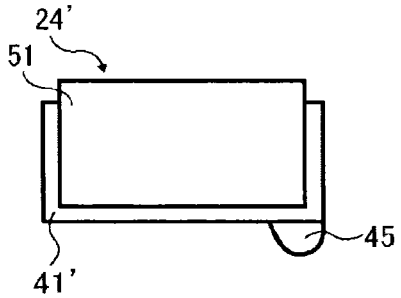
FIG. 7B is a schematic sectional view of a variation of the nip formation pad shown in FIG. 7A.

FIG. 7B is a schematic sectional view of a nip formation pad 24' as a variation of the nip formation pad 24 shown in FIG. 7A. As shown in FIG. 7B, the base 51 is mounted on an equalizer 41' in a thickness direction thereof perpendicular to the sheet conveyance direction A1 such that a length of the equalizer 41' is greater than a length of the base 51 in the sheet conveyance direction A1. For example, an upstream arm and a downstream arm of the equalizer 41' in the sheet conveyance direction A1 sandwich the base 51. The base 51 situated inward from each of the equalizers 41 and 41' inside the loop formed by the fixing belt 21 prevents excessive inward diffusion of heat from the equalizers 41 and 41', reducing waste of energy. Additionally, the base 51 extending in the axial direction of the fixing belt 21 facilitates conduction of heat in a longitudinal direction of the nip formation pad 24' parallel to the axial direction of the fixing belt 21.

Figure 8A:
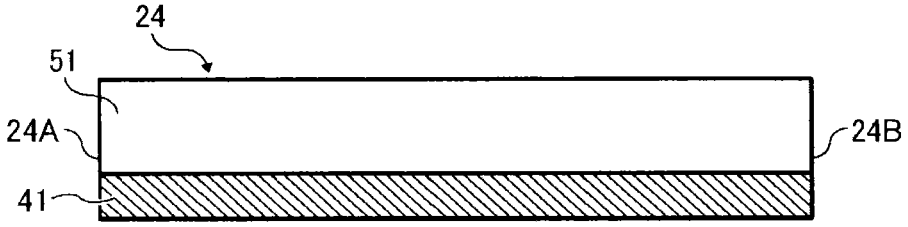
FIG. 8A is a sectional view of the nip formation pad incorporated in the fixing device shown in FIG. 6 taken along line LA-LA in FIG. 6.
Figure 8B:
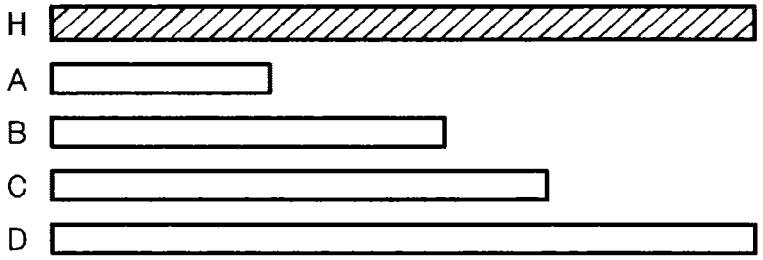
FIG. 8B is a diagram illustrating positional relations between the light emission span of the halogen heater incorporated in the fixing device shown in FIG. 6 and the four conveyance spans of sheets conveyed through the fixing device.

FIG. 8A is a sectional view of the nip formation pad 24 taken along line LA-LA in FIG. 6. FIG. 8A illustrates a half of the nip formation pad 24 in the longitudinal direction thereof parallel to the axial direction of the fixing belt 21, from the center 24A to the lateral edge 24B of the nip formation pad 24 in the longitudinal direction thereof. FIG. 8B is a diagram illustrating positional relations between the light emission span H of the halogen heater 23 and the four conveyance spans A, B, C, and D of sheets P of four sizes in the longitudinal direction of the halogen heater 23 parallel to the axial direction of the fixing belt 21.

Figure 8C:
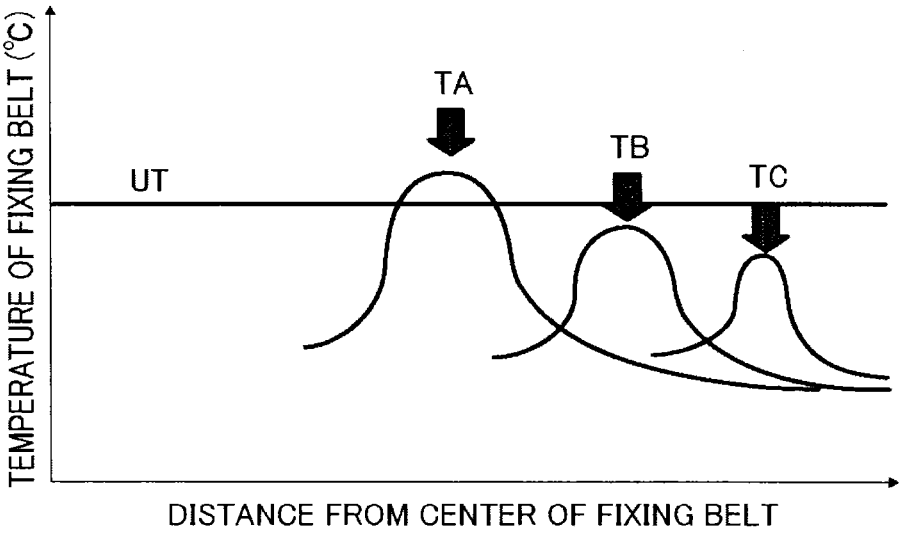
FIG. 8C is a graph showing a relation between the distance from the center of the fixing belt incorporated in the fixing device shown in FIG. 6 and the temperature of the fixing belt.

FIG. 8C is a graph showing a relation between the distance from the center of the fixing belt 21 in the axial direction thereof and the temperature of the fixing belt 21 in the non-conveyance span outboard from the conveyance spans A, B, C, and D in the axial direction of the fixing belt 21 as sheets P of four sizes are conveyed over the fixing belt 21. FIG. 8C illustrates the temperatures TA, TB, and TC in the non-conveyance span, that is, the lateral end of the fixing belt 21 in the axial direction thereof, where the sheet P is not conveyed over the fixing belt 21. The equalizer 41 contacting the inner circumferential surface of the fixing belt 21 at the fixing nip N extends in a span corresponding to the entire span of the halogen heater 23 in the longitudinal direction thereof parallel to the axial direction of the fixing belt 21. Accordingly, regardless of the sizes of sheets P, the equalizer 41 suppresses overheating of both lateral ends of the fixing belt 21 in the axial direction thereof as shown in FIG. 8C.

Alternatively, the base 51 disposed opposite the fixing belt 21 via the equalizer 41 may be made of a material having an increased thermal conductivity to increase the thermal capacity of the equalizer 41 and thereby cause the equalizer 41 to suppress overheating of both lateral ends of the fixing belt 21 in the axial direction thereof effectively. The thermal capacity of the equalizer 41 in direct contact with the fixing belt 21 is adjusted to prevent the equalizer 41 from absorbing heat from the fixing belt 21 excessively.

For example, the thermal capacity of the equalizer 41 is optimized. In order to prevent overheating of both lateral ends of the fixing belt 21 in the axial direction thereof while saving energy, a heat flux from the fixing belt 21 to the base 51 is optimized. The thermal capacity of each of the equalizer 41, the base 51, and the low-friction sheet is optimized by considering the combined thermal resistance of the equalizer 41, the base 51, and the low-friction sheet. For example, with the combination of the equalizer 41 made of copper and the base 51 made of heat resistant resin, the thickness of the equalizer 41 is in a range of from about 9 micrometers to about 3 mm.

On the other hand, if the equalizer 41 is planar, the planar equalizer 41 may degrade separation of the sheet P bearing the fixed toner image T from the fixing belt 21.

Figure 9A:
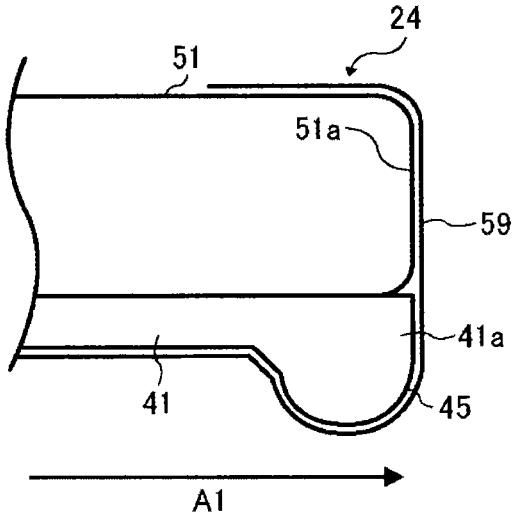
FIG. 9A is a partial sectional view of the nip formation pad shown in FIG. 7A and a low-friction sheet coating the nip formation pad illustrating a downstream section of the nip formation pad.

With reference to FIGS. 9A, 9B, 9C, and 9D, a description is provided of configurations of the components that form the fixing nip N. FIG. 9A is a partial sectional view of the nip formation pad 24 illustrating a downstream section thereof, that is, the exit of the fixing nip N, in the sheet conveyance direction A1.

As shown in FIG. 9A, a bulge 45 projects from the equalizer 41 toward the pressure roller 22 depicted in FIG. 6 at a downstream end 41*a* of the equalizer 41 in the sheet conveyance direction A1 disposed opposite the exit of the fixing nip N, that is, a downstream end of the fixing nip N in the sheet conveyance direction A1. The bulge 45 lifts the sheet P bearing the fixed toner image T that is conveyed through the exit of the fixing nip N from the fixing belt 21, facilitating separation of the sheet P from the fixing belt 21. A low-friction sheet 59 serving as a slide aid is wound around the nip formation pad 24. For example, the low-friction sheet 59 coats the equalizer 41, the bulge 45, and the base 51.

Figure 9B:
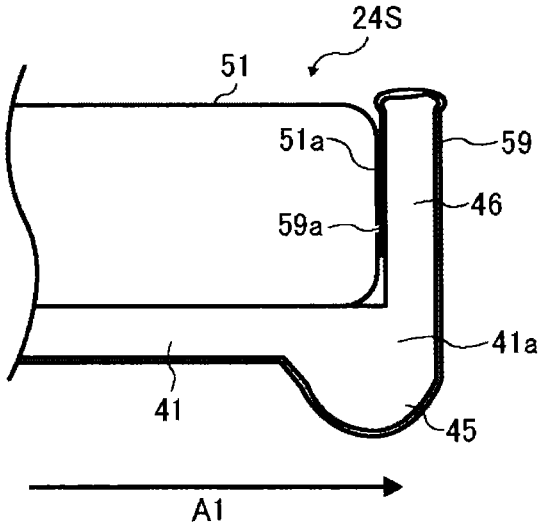
FIG. 9B is a partial sectional view of a nip formation pad and the low-friction sheet as a first variation of the nip formation pad shown in FIG. 9A.

FIG. 9B is a partial sectional view of a nip formation pad 24S illustrating a downstream section thereof. As shown in FIG. 9B, the bulge 45 projects from the equalizer 41 toward the pressure roller 22 at the downstream end 41*a* of the equalizer 41. A stopper 46 projects from the equalizer 41 toward the stay 25 depicted in FIG. 6 in a direction opposite a direction in which the bulge 45 projects from the equalizer 41, that is, a thickness direction of the nip formation pad 24S perpendicular to the sheet conveyance direction A1, at the downstream end 41*a* of the equalizer 41 along a downstream face 51*a* of the base 51. The stopper 46 prevents the equalizer 41 from moving in a circumferential direction of the fixing belt 21 even when the equalizer 41 receives a predetermined force from the fixing belt 21 rotating in the rotation direction R3 and the sheet P conveyed in the sheet conveyance direction A1. The low-friction sheet 59 is wound around the nip formation pad 24S. For example, the low-friction sheet 59 coats the equalizer 41, the bulge 45, and the stopper 46. An end 59*a* of the low-friction sheet 59 is nipped by and fixed between the base 51 and the stopper 46.

Figure 9C:
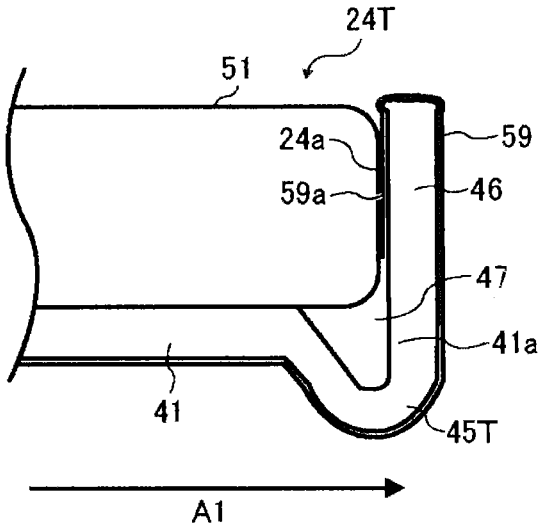
FIG. 9C is a partial sectional view of a nip formation pad and the low-friction sheet as a second variation of the nip formation pad shown in FIG. 9A.

FIG. 9C is a partial sectional view of a nip formation pad 24T illustrating a downstream section thereof. A single copper plate constituting the equalizer 41 is bent to produce a bulge 45T that projects from the equalizer 41 toward the pressure roller 22 at the downstream end 41*a* of the equalizer 41. Thus, the bulge 45T and the equalizer 41 are manufactured at reduced costs. The low-friction sheet 59 coats the equalizer 41. The end 59*a* of the low-friction sheet 59 is nipped by and fixed between the base 51 and the stopper 46. However, a recess 47 is defined by the bulge 45T, the equalizer 41, and the base 51. Accordingly, the base 51, the equalizer 41, and the bulge 45T produce an air layer surrounded by them, which degrades heat conduction between the base 51 and the equalizer 41.

Figure 9D:
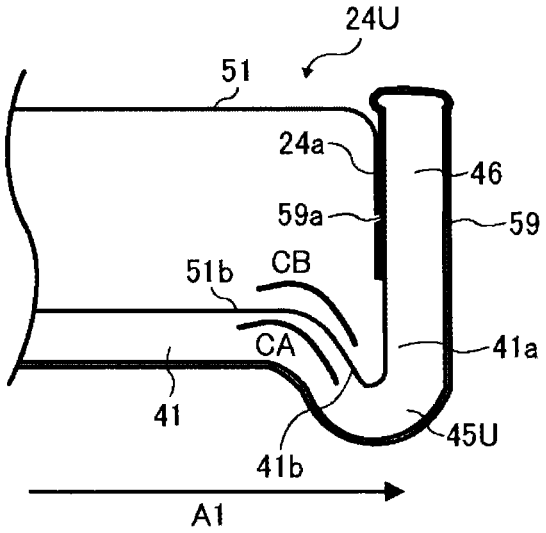
FIG. 9D is a partial sectional view of a nip formation pad and the low-friction sheet as a third variation of the nip formation pad shown in FIG. 9A.

To address this circumstance, the base 51 may be contoured as shown in FIG. 9D. FIG. 9D is a partial sectional view of a nip formation pad 24U illustrating a downstream section thereof. As shown in FIG. 9D, the base 51 serving as a resin layer includes a curved portion 51*b* curved along a curved portion 41*b* of the equalizer 41 bent and curved to create a bulge 45U. A curvature CB of the curved portion 51*b* of the base 51 is smaller than a curvature CA of the curved portion 41*b* of the equalizer 41. Accordingly, as the pressure roller 22 is pressed against the base 51 via the fixing belt 21 and the equalizer 41, the equalizer 41 is pressed against the base 51 precisely without being lifted from the base 51. The low-friction sheet 59 coats the equalizer 41, the bulge 45U, and the stopper 46. The end 59*a* of the low-friction sheet 59 is nipped by and fixed between the base 51 and the stopper 46.

Figure 10A:
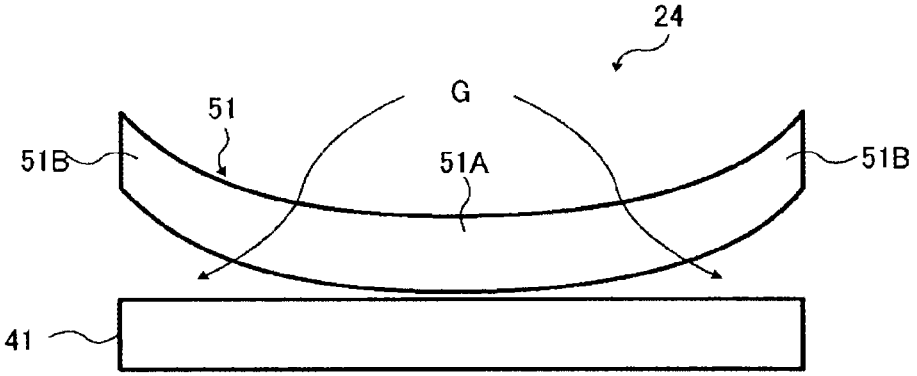
FIG. 10A is a schematic sectional view of a base and an equalizer of the nip formation pad shown in FIG. 9A when a gap is produced therebetween.
Figure 10B:
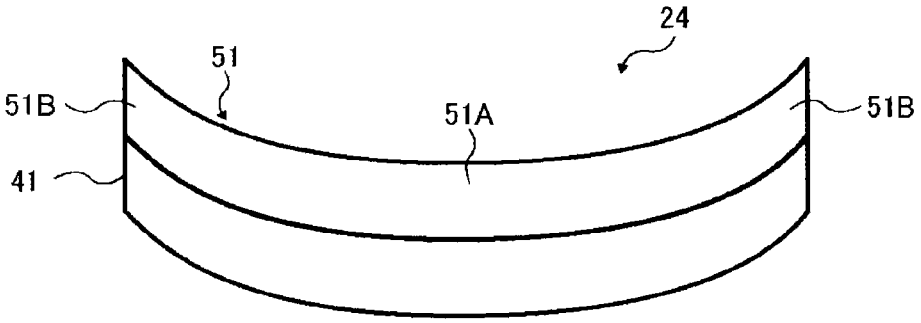
FIG. 10B is a schematic sectional view of the base and the equalizer of the nip formation pad shown in FIG. 9A when no gap is produced therebetween.

With reference to FIGS. 10A and 10B, a description is provided of a first variation of the configurations of the components that form the fixing nip N described above.

FIG. 10A is a schematic sectional view of the equalizer 41 and the base 51 constituting the nip formation pad 24 seen in a direction perpendicular to the longitudinal direction thereof parallel to the axial direction of the fixing belt 21 when a gap G is produced between the equalizer 41 and the base 51. As shown in FIG. 10A, the gap G is produced between the equalizer 41 and the base 51 serving as the resin layer due to the shape of the base 51 and pressure between the pressure roller 22 and the base 51. As shown in FIG. 6, the base 51 is supported by the stay 25 situated inward from the base 51 inside the loop formed by the fixing belt 21. Both lateral ends of the stay 25 in a longitudinal direction thereof are mounted on the side plates of the fixing device 20, respectively. If the pressure roller 22 has a hand drum shape or an hour glass shape in which the diameter of a center in the axial direction thereof is smaller than the diameter of each lateral end in the axial direction thereof, the diameter of a center 51A of the base 51 in a longitudinal direction thereof is greater than the diameter of each lateral end 51B of the base 51 in the longitudinal direction thereof so that the center 51A of the base 51 projects toward the center of the pressure roller 22. Thus, as the pressure roller 22 is pressed against the base 51, the pressure roller 22 forms the fixing nip N even at the center of the pressure roller 22. However, if the modulus of elasticity or the rigidity of the pressure roller 22, the equalizer 41, and base 51 is not considered, the gap G may be produced between the equalizer 41 and the base 51.

FIG. 10B is a schematic sectional view of the equalizer 41 and the base 51 seen in the direction perpendicular to the longitudinal direction thereof parallel to the axial direction of the fixing belt 21 when no gap is produced between the equalizer 41 and the base 51. In order to adhere the equalizer 41 to the base 51 as the pressure roller 22 is pressed against the base 51, a modulus of elasticity of the equalizer 41 is smaller than a modulus of elasticity of the base 51 as shown in FIG. 10B. Conversely, if a modulus of elasticity of the equalizer 41 is greater than a modulus of elasticity of the base 51 as shown in FIG. 10A, the equalizer 41 is not bent in conformity with bending of the base 51, producing the gap G therebetween.

Figure 11A:
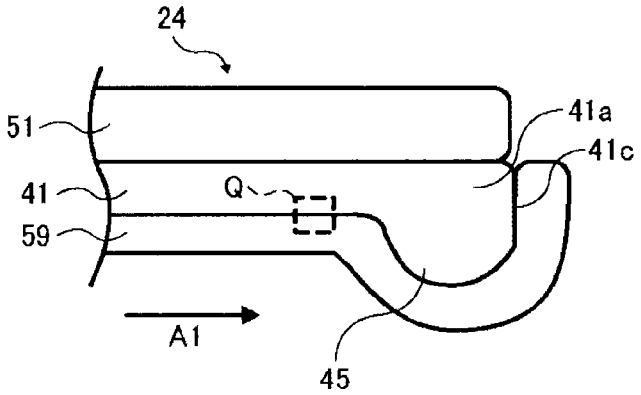
FIG. 11A is a partial sectional view of the nip formation pad shown in FIG. 9A illustrating the low-friction sheet coating the equalizer and a bulge of the nip formation pad.
Figure 11B:
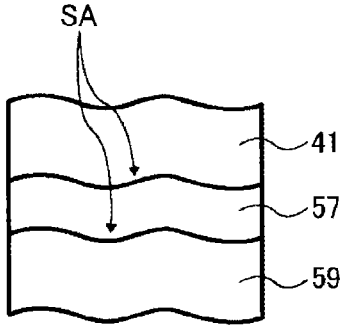
FIG. 11B is a partially enlarged sectional view of the equalizer and the low-friction sheet shown in FIG. 11A illustrating an elastic layer sandwiched therebetween.

With reference to FIGS. 11A and 11B, a description is provided of a second variation of the configurations of the components that form the fixing nip N described above.

FIG. 11A is a partial sectional view of the nip formation pad 24 illustrating the downstream section thereof, that is, the exit of the fixing nip N, in the sheet conveyance direction A1.

As shown in FIG. 11A, the low-friction sheet 59 serving as a slide aid is sandwiched between the equalizer 41 and the fixing belt 21 at the fixing nip N. The low-friction sheet 59 reduces abrasion of the inner circumferential surface of the fixing belt 21, facilitating sliding of the fixing belt 21 over the equalizer 41. The low-friction sheet 59 coats the bulge 45 mounted on the equalizer 41 and a downstream face 41*c* of the equalizer 41. That is, the low-friction sheet 59 is curved along the bulge 45 and extended along the downstream face 41*c* of the equalizer 41. The low-friction sheet 59 is manufactured separately from the equalizer 41 and inserted into a gap between the equalizer 41 and the fixing belt 21. Alternatively, the low-friction sheet 59 may be produced by coating a nip face of the equalizer 41 disposed opposite the fixing nip N with a slide aid material. According to this exemplary embodiment, the low-friction sheet 59 serving as a slide aid is inserted into the gap between the equalizer 41 and the fixing belt 21. In this case, surface asperities of the low-friction sheet 59 may reduce the area of the low-friction sheet 59 where the low-friction sheet 59 contacts the equalizer 41, obstructing conduction of heat from the fixing belt 21 to the equalizer 41. To address this circumstance, that is, to secure an increased area of the low-friction sheet 59 where the low-friction sheet 59 contacts the equalizer 41 and thereby facilitate conduction of heat from the fixing belt 21 to the equalizer 41, an elastic layer 57 may be interposed or sandwiched between the equalizer 41 and the low-friction sheet 59 as shown in FIG. 11B.

FIG. 11B is a partially enlarged sectional view of the equalizer 41, the elastic layer 57, and the low-friction sheet 59 illustrating a cutaway portion Q shown in FIG. 11A. The elastic layer 57 is conductive tape that prevents the low-friction sheet 59 from shifting relative to the equalizer 41 during continuous sliding of the fixing belt 21 over the low-friction sheet 59 while attaining enhanced heat conduction. For example, the conductive tape is metal tape. Alternatively, if grease is applied between the equalizer 41 and the low-friction sheet 59 to attain appropriate sliding of the low-friction sheet 59 over the equalizer 41, conductive grease may be used to enhance heat conduction. For example, the conductive grease is silicone grease or grease added with conductive particles such as zinc oxide.

With reference to FIGS. 12, 13A, 13B, and 13C, a description is provided of a construction of a fixing device 20V according to another exemplary embodiment.

Figure 12:
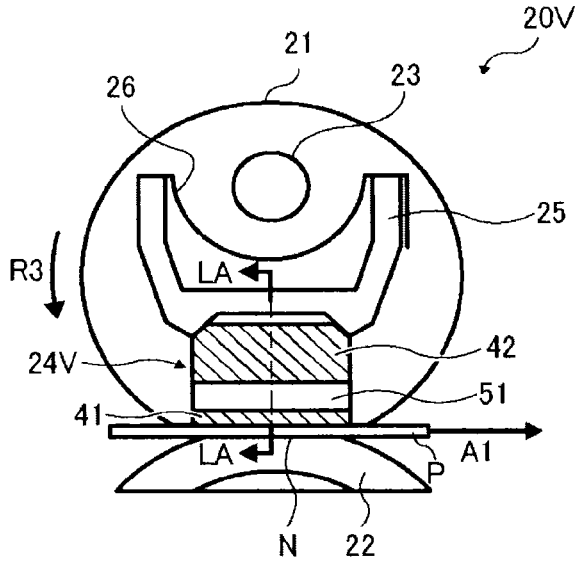
FIG. 12 is a partial schematic vertical sectional view of a fixing device according to a second exemplary embodiment.
Figure 13A:
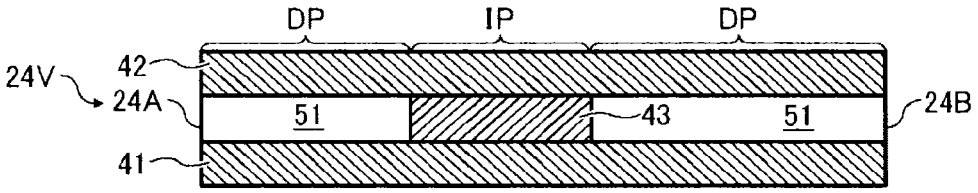
FIG. 13A is a sectional view of a nip formation pad incorporated in the fixing device shown in FIG. 12 taken along line LA-LA in FIG. 12.
Figure 13B:
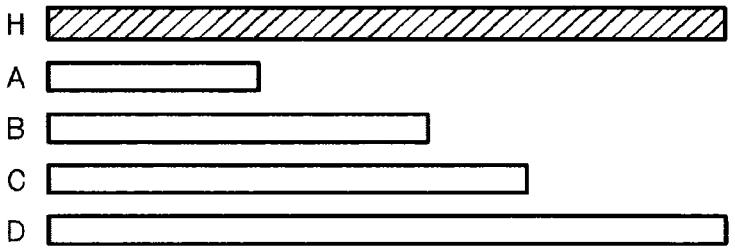
FIG. 13B is a diagram illustrating positional relations between the light emission span of the halogen heater incorporated in the fixing device shown in FIG. 12 and the four conveyance spans of sheets conveyed through the fixing device.
Figure 13C:
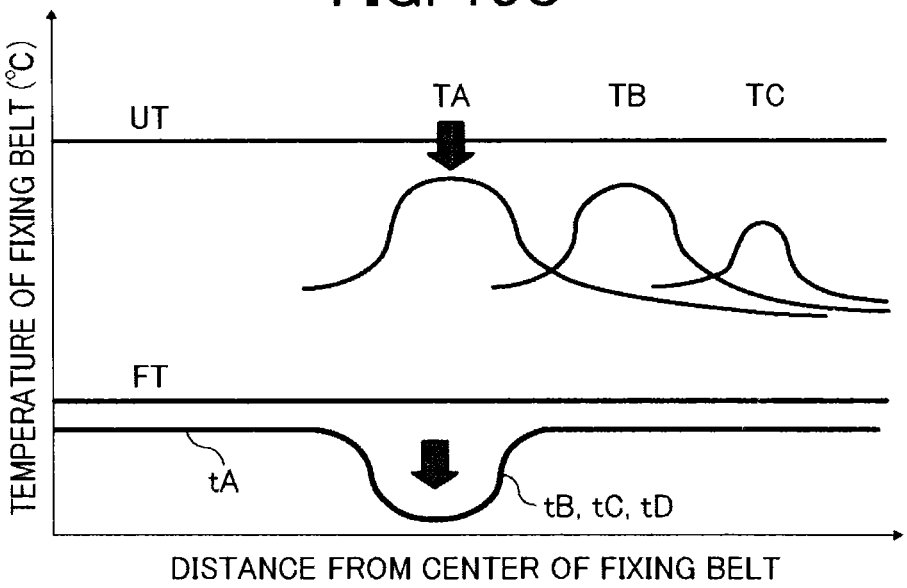
FIG. 13C is a graph showing a relation between the distance from the center of the fixing belt incorporated in the fixing device shown in FIG. 12 and the temperature of the fixing belt.

FIG. 12 is a partial vertical sectional view of the fixing device 20V. FIG. 13A is a sectional view of a nip formation pad 24V taken along line LA-LA in FIG. 12. FIG. 13B is a diagram illustrating positional relations between the light emission span H of the halogen heater 23 and the four conveyance spans A, B, C, and D of sheets P of four sizes in the longitudinal direction of the halogen heater 23. FIG. 13C is a graph showing a relation between the distance from the center of the fixing belt 21 in the axial direction thereof and the temperature of the fixing belt 21 in the non-conveyance span outboard from the conveyance spans A, B, C, and D in the axial direction of the fixing belt 21 as sheets P of four sizes are conveyed over the fixing belt 21. FIG. 13C illustrates the temperatures TA, TB, and TC in the non-conveyance span, that is, the lateral end of the fixing belt 21 in the axial direction thereof, where the sheet P is not conveyed over the fixing belt 21 and temperatures tA, tB, tC, and tD in the conveyance span, that is, the center of the fixing belt 21 in the axial direction thereof, where the sheet P is conveyed over the fixing belt 21.

As shown in FIG. 12, the fixing device 20V includes the equalizer 41 sandwiched between the base 51 and the fixing belt 21 at the fixing nip N and extended in the longitudinal direction thereof parallel to the axial direction of the fixing belt 21. The equalizer 41 serving as a first thermal conductor is made of a material having a thermal conductivity greater than that of the base 51. The fixing device 20V further includes an absorber 42 serving as a third thermal conductor sandwiched between the base 51 and the stay 25 and extended in a longitudinal direction thereof parallel to the axial direction of the fixing belt 21. The absorber 42 is disposed opposite the fixing belt 21 via the base 51 and the equalizer 41 at the fixing nip N and in contact with the base 51. The absorber 42 is made of a material having a thermal conductivity greater than that of the base 51.

As shown in FIG. 13A, an absorber 43 serving as a second thermal conductor smaller than the equalizer 41 and the absorber 42 in the longitudinal direction of the equalizer 41 and the absorber 42 is sandwiched between the equalizer 41 and the absorber 42. The absorber 43 is made of a material having a thermal conductivity greater than that of the base 51. The absorber 43 is disposed opposite the fixing belt 21 via the equalizer 41 in the non-conveyance span on the fixing belt 21 outboard from the smallest conveyance span A in the axial direction of the fixing belt 21 where the fixing belt 21 is susceptible to overheating to the temperature TA. For example, the absorber 43 is disposed opposite an overheating span of the fixing belt 21 in the axial direction thereof where the fixing belt 21 is susceptible to overheating. The overheating span of the fixing belt 21 includes at least a part of the non-conveyance span on the fixing belt 21 and a contiguous span contiguous to the non-conveyance span in the axial direction of the fixing belt 21, that is, a part of the conveyance span on the fixing belt 21 where the sheet P is conveyed over the fixing belt 21.

Thus, the nip formation pad 24V includes the base 51, the equalizer 41, and the absorbers 42 and 43.

As shown in FIG. 13A, the nip formation pad 24V includes an increased thermal conduction portion IP and a decreased thermal conduction portion DP. In the increased thermal conduction portion IP, the nip formation pad 24V is constructed of a plurality of layers: the equalizer 41 and the absorbers 43 and 42. Conversely, in each decreased thermal conduction portion DP, the nip formation pad 24V is constructed of a plurality of layers: the equalizer 41, the base 51, and the absorber 42. The thermal conductivity of the base 51 is different from that of the equalizer 41 and the absorbers 42 and 43. For example, the thermal conductivity of the equalizer 41 and the absorbers 42 and 43 is greater than that of the base 51. Thus, the nip formation pad 24V is constructed of a plurality of layers made of a plurality of materials having different thermal conductivities, respectively, that are layered in a thickness direction of the nip formation pad 24V.

The increased thermal conduction portion IP corresponding to the absorber 43 having an increased thermal conductivity provides a combined thermal conductivity combining thermal conductivities of the equalizer 41 and the absorbers 42 and 43 in the thickness direction of the nip formation pad 24V that is greater than a combined thermal conductivity combining thermal conductivities of the equalizer 41, the base 51, and the absorber 42 in each decreased thermal conduction portion DP not corresponding to the absorber 43. Accordingly, the increased thermal conduction portion IP of the nip formation pad 24V absorbs heat from the fixing belt 21 readily. Consequently, even if the fixing belt 21 overheats substantially at an axial span thereof corresponding to the increased thermal conduction portion IP of the nip formation pad 24V, the nip formation pad 24V absorbs heat from the fixing belt 21 upward in FIG. 13A in the thickness direction of the nip formation pad 24V, thus suppressing overheating of the fixing belt 21.

The equalizer 41 facilitates conduction of heat in the longitudinal direction thereof parallel to the axial direction of the fixing belt 21, equalizing an amount of heat stored in the fixing belt 21 and thereby suppressing overheating of both lateral ends of the fixing belt 21 in the axial direction thereof. Conversely, the absorbers 42 and 43 facilitate conduction of heat in the thickness direction of the nip formation pad 24V perpendicular to the longitudinal direction thereof and absorb heat from the base 51 and the equalizer 41. As shown in FIGS. 13A and 13C, the absorber 43 is disposed opposite the greater non-conveyance span of the fixing belt 21 that is outboard from the smaller conveyance span A on the fixing belt 21 in the axial direction thereof and is susceptible to overheating to the temperature TA. The absorber 43 absorbs heat from the base 51 and the equalizer 41 and conducts the absorbed heat to the absorber 42 in contact with the absorber 43. That is, the absorbers 42 and 43 supplement shortage of thermal capacity of the equalizer 41. For example, the absorber 42 has an increased thermal capacity or an increased surface area to increase heat dissipation.

However, the equalizer 41, as it has a predetermined thickness, absorbs heat in the thickness direction thereof. Each of the absorbers 42 and 43, as it has an axial span in the axial direction of the fixing belt 21, equalizes heat in the axial direction of the fixing belt 21. Hence, the equalizer 41 achieves absorption as well as equalization. Similarly, the absorbers 42 and 43 achieve equalization as well as absorption.

With reference to FIGS. 14, 15A, 15B, 15C, and 16, a description is provided of a construction of a fixing device 20W according to yet another exemplary embodiment.

Figure 14:
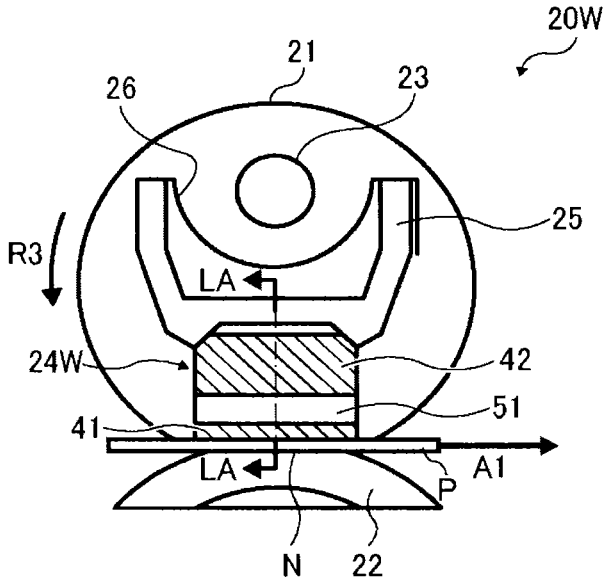
FIG. 14 is a partial schematic vertical sectional view of a fixing device according to a third exemplary embodiment.
Figure 15A:
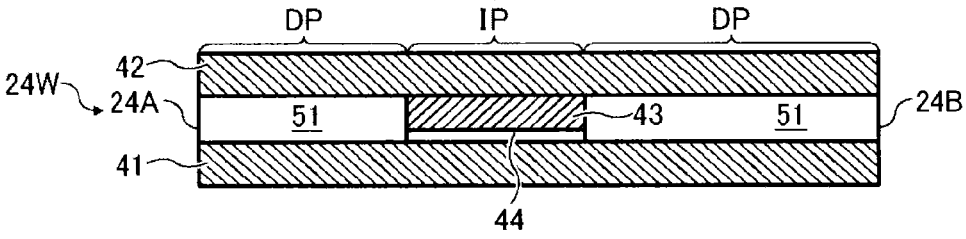
FIG. 15A is a sectional view of a nip formation pad incorporated in the fixing device shown in FIG. 14 taken along line LA-LA in FIG. 14.
Figure 15B:
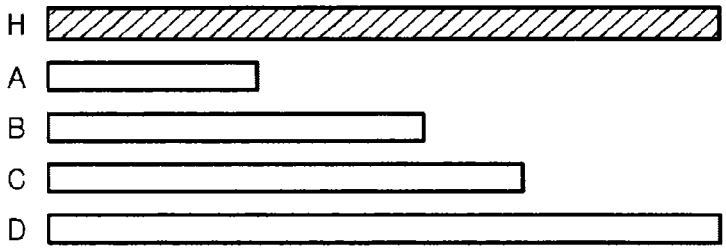
FIG. 15B is a diagram illustrating positional relations between the light emission span of the halogen heater incorporated in the fixing device shown in FIG. 14 and the four conveyance spans of sheets conveyed through the fixing device.
Figure 15C:
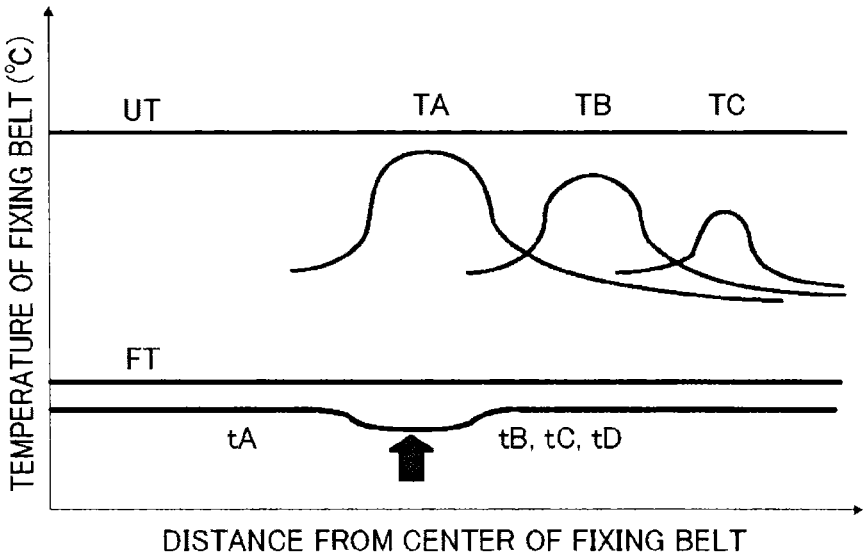
FIG. 15C is a graph showing a relation between the distance from the center of the fixing belt incorporated in the fixing device shown in FIG. 14 and the temperature of the fixing belt.
Figure 16:
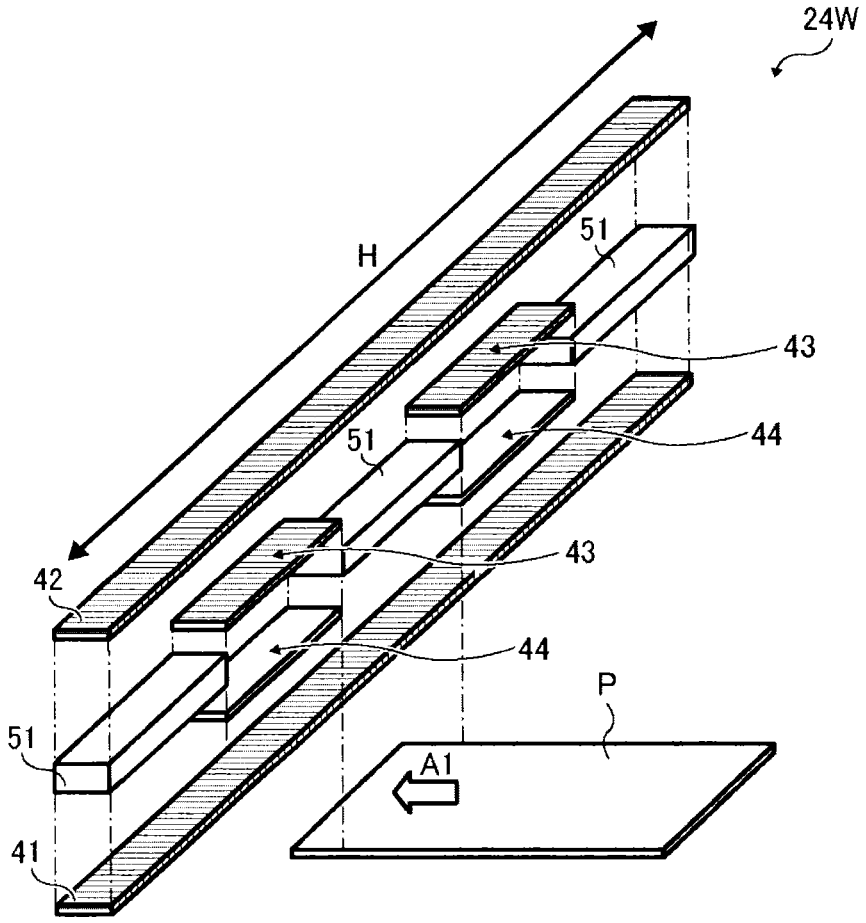
FIG. 16 is a schematic exploded perspective view of the nip formation pad shown in FIG. 15A.

FIG. 14 is a partial vertical sectional view of the fixing device 20W. FIG. 15A is a sectional view of a nip formation pad 24W taken along line LA-LA in FIG. 14. FIG. 15B is a diagram illustrating positional relations between the light emission span H of the halogen heater 23 and the four conveyance spans A, B, C, and D of sheets P of four sizes in the longitudinal direction of the halogen heater 23. FIG. 15C is a graph showing a relation between the distance from the center of the fixing belt 21 in the axial direction thereof and the temperature of the fixing belt 21 in the non-conveyance span outboard from the conveyance spans A, B, C, and D in the axial direction of the fixing belt 21 as sheets P of four sizes are conveyed over the fixing belt 21. FIG. 15C illustrates the temperatures TA, TB, and TC in the non-conveyance span, that is, the lateral end of the fixing belt 21 in the axial direction thereof, where the sheet P is not conveyed over the fixing belt 21 and the temperatures tA, tB, tC, and tD in the conveyance span, that is, the center of the fixing belt 21 in the axial direction thereof, where the sheet P is conveyed over the fixing belt 21. FIG. 16 is a schematic exploded perspective view of the nip formation pad 24W illustrating an A6 size sheet P conveyed in the sheet conveyance direction A1.

As shown in FIG. 14, the fixing device 20W includes the equalizer 41 sandwiched between the base 51 and the fixing belt 21 at the fixing nip N and extended in the longitudinal direction thereof parallel to the axial direction of the fixing belt 21. The equalizer 41 serving as a first thermal conductor is made of a material having a thermal conductivity greater than that of the base 51. The fixing device 20W further includes the absorber 42 serving as a third thermal conductor sandwiched between the base 51 and the stay 25 and extended in the longitudinal direction thereof parallel to the axial direction of the fixing belt 21. The absorber 42 is disposed opposite the fixing belt 21 via the base 51 and the equalizer 41 at the fixing nip N and in contact with the base 51. The absorber 42 is made of a material having a thermal conductivity greater than that of the base 51.

As shown in FIG. 15A, the absorber 43 serving as a second thermal conductor smaller than the equalizer 41 and the absorber 42 in the longitudinal direction of the equalizer 41 and the absorber 42 is sandwiched between the equalizer 41 and the absorber 42. The absorber 43 is made of a material having a thermal conductivity greater than that of the base 51. For example, like the absorber 43 of the nip formation pad 24V depicted in FIG. 13A, the absorber 43 of the nip formation pad 24W depicted in FIG. 15A is disposed opposite the overheating span of the fixing belt 21 in the axial direction thereof where the fixing belt 21 is susceptible to overheating. The overheating span of the fixing belt 21 includes at least a part of the non-conveyance span on the fixing belt 21 where the sheet P is not conveyed over the fixing belt 21 and the contiguous span contiguous to the non-conveyance span in the axial direction of the fixing belt 21, that is, a part of the conveyance span on the fixing belt 21 where the sheet P is conveyed over the fixing belt 21.

The equalizer 41 facilitates conduction of heat in the longitudinal direction thereof parallel to the axial direction of the fixing belt 21, equalizing an amount of heat stored in the fixing belt 21 and thereby suppressing overheating of both lateral ends of the fixing belt 21 in the axial direction thereof. Conversely, the absorbers 42 and 43 facilitate conduction of heat in a thickness direction of the nip formation pad 24W perpendicular to a longitudinal direction thereof and absorb heat from the base 51 and the equalizer 41. As shown in FIGS. 15A and 15C, the absorber 43 disposed opposite the fixing belt 21 via the equalizer 41 is disposed opposite the greater non-conveyance span of the fixing belt 21 that is outboard from the smaller conveyance span A on the fixing belt 21 in the axial direction thereof and is susceptible to overheating to the temperature TA. The absorber 43 absorbs heat from the base 51 and the equalizer 41 and conducts the absorbed heat to the absorber 42 in contact with the absorber 43. That is, the absorbers 42 and 43 supplement shortage of thermal capacity of the equalizer 41. For example, the absorber 42 has an increased thermal capacity or an increased surface area to increase heat dissipation.

As shown in FIG. 14, since a space inside the loop formed by the fixing belt 21 is limited, the absorber 42 is interposed between the base 51 constituting the resin layer and the stay 25 and extended in the longitudinal direction thereof parallel to the axial direction of the fixing belt 21. Alternatively, if a space is available, the absorber 42 may be upsized in the axial direction or the circumferential direction of the fixing belt 21 to increase the thermal capacity of the absorber 42. Yet alternatively, the absorber 42 may contact the stay 25 to increase an apparent thermal capacity of the absorber 42. In this case, the stay 25 needs to be cooler than the absorber 42. Accordingly, in order to suppress conduction of heat from the reflector 26 heated by the halogen heater 23 to the stay 25, an air layer or an insulation layer made of an insulation material is interposed between the reflector 26 and the stay 25. Yet alternatively, instead of the absorber 42, the stay 25 having a thermal capacity greater than that of the base 51 may contact the absorber 43 to absorb heat from the absorber 43 and the base 51.

The absorbers 42 and 43 are made of metal such as copper. Alternatively, the absorbers 42 and 43 may be made of resin in view of temperature increase in the non-conveyance span produced at both lateral ends of the fixing belt 21 in the axial direction thereof.

Table 1 below shows the material and the thermal conductivity of the equalizer 41 and the absorbers 42 and 43.

TABLE 1

| Material | Thermal conductivity (W/mK) |
|---|---|
| Carbon nanotube | 3,000 to 5,500 |
| Graphite sheet | 700 to 1,750 |
| Silver | 420 |
| Copper | 398 |
| Aluminum | 236 |

Table 2 below shows the material and the thermal conductivity of the base 51.

TABLE 2

| Material (heat resistant resin) | Thermal conductivity (W/mK) |
|---|---|
| PPS | 0.20 |
| PAI | 0.29 to 0.60 |
| PEEK | 0.26 |
| PEK (polyetherketone) | 0.29 |
| LCP | 0.38 to 0.56 |

As shown in FIGS. 15A and 16, the nip formation pad 24W further includes a resin layer 44 sandwiched between the equalizer 41 and the absorber 43. Hence, the nip formation pad 24W includes the base 51, the equalizer 41, the absorbers 42 and 43, and the resin layer 44. The resin layer 44 is made of a material having a thermal conductivity smaller than that of the absorber 43. The resin layer 44 interposed between the equalizer 41 and the absorber 43 in contact with the absorber 42 reduces an amount of heat conducted from the equalizer 41 to the absorber 42 through the absorber 43. Accordingly, the temperature TA of the non-conveyance span outboard from the conveyance span A on the fixing belt 21 in the axial direction thereof is suppressed to a temperature lower than the upper limit of target temperature UT of the fixing belt 21 and at the same time shortage of heat in the conveyance span on the fixing belt 21 indicated by the temperatures tB, tC, and tD depicted in FIG. 15C that may lower the temperature of the fixing belt 21 below a fixing temperature FT is prevented while saving power.

If the resin layer 44 is thick excessively, the thick resin layer 44 may prohibit heat stored in the fixing belt 21 from being conducted to the absorber 42, rendering the fixing belt 21 to be susceptible to overheating of the non-conveyance span produced at both lateral ends of the fixing belt 21 in the axial direction thereof. It is necessary to determine the thickness and the length of the resin layer 44 based on the degree of overheating of both lateral ends of the fixing belt 21 in the axial direction thereof. Overheating of both lateral ends of the fixing belt 21 in the axial direction thereof that may not be overcome by the equalizer 41 may occur at a plurality of spots spaced apart from each other. To address this circumstance, a plurality of absorbers 43 is disposed opposite the plurality of overheated spots on the fixing belt 21, respectively. For example, as shown in FIG. 16, the plurality of absorbers 43 may be aligned in the longitudinal direction of the equalizer 41. In this case, the thickness and the length of the resin layer 44 are determined based on the degree of overheating at the respective spots on both lateral ends of the fixing belt 21 in the axial direction thereof. The combined thickness of the absorber 43 and the resin layer 44 is equivalent to the thickness of the base 51, allowing the absorber 43 to come into surface contact with the absorber 42 and thereby facilitating conduction of heat from the absorber 43 to the absorber 42 and vice versa.

Like the nip formation pad 24V shown in FIG. 13A, the nip formation pad 24W shown in FIG. 15A is constructed of a plurality of layers: the equalizer 41, the resin layer 44, and the absorbers 43 and 42 in the increased thermal conduction portion IP. Conversely, the nip formation pad 24W is constructed of a plurality of layers: the equalizer 41, the base 51, and the absorber 42 in each decreased thermal conduction portion DP. The thermal conductivity of the base 51 and the resin layer 44 is different from that of the equalizer 41 and the absorbers 42 and 43. For example, the thermal conductivity of the equalizer 41 and the absorbers 42 and 43 is greater than that of the base 51 and the resin layer 44. Thus, the nip formation pad 24W is constructed of a plurality of layers made of a plurality of materials having different thermal conductivities, respectively, that are layered vertically in FIG. 15A in the thickness direction of the nip formation pad 24W.

The increased thermal conduction portion IP corresponding to the absorber 43 having an increased thermal conductivity provides a combined thermal conductivity combining thermal conductivities of the equalizer 41, the resin layer 44, and the absorbers 42 and 43 in the thickness direction of the nip formation pad 24W that is greater than a combined thermal conductivity combining thermal conductivities of the equalizer 41, the base 51, and the absorber 42 in each decreased thermal conduction portion DP not corresponding to the absorber 43. Accordingly, the increased thermal conduction portion IP of the nip formation pad 24W absorbs heat from the fixing belt 21 readily. Consequently, even if the fixing belt 21 overheats substantially at an axial span thereof corresponding to the increased thermal conduction portion IP of the nip formation pad 24W, the nip formation pad 24W absorbs heat from the fixing belt 21 upward in FIG. 15A in the thickness direction of the nip formation pad 24W, thus suppressing overheating of the fixing belt 21.

The equalizer 41, the absorbers 42 and 43, the resin layer 44, and the base 51 that constitute the nip formation pad 24W have the thickness for the length of about 10 mm of the fixing nip N in the sheet conveyance direction A1. For example, the equalizer 41 has a thickness in a range of from about 0.2 mm to about 0.6 mm. The absorber 42 has a thickness in a range of from about 1.8 mm to about 6.0 mm. The absorber 43 has a thickness in a range of from about 1.0 mm to about 2.0 mm. The resin layer 44 has a thickness in a range of from about 0.5 mm to about 1.5 mm. The base 51 has a thickness in a range of from about 1.5 mm to about 3.5 mm. However, the thickness of each of the equalizer 41, the absorbers 42 and 43, the resin layer 44, and the base 51 is not limited to the above.

A rim projecting from each lateral end of the equalizer 41 in the sheet conveyance direction A1 toward the absorber 42 may extend throughout the entire span of the equalizer 41 in the longitudinal direction thereof. The equalizer 41 and the rim mounted thereon produce a U-like shape in cross-section that accommodates the base 51, the resin layer 44, and the absorbers 42 and 43 that are layered on the equalizer 41. Alternatively, a projection may project from an inner face of the equalizer 41 to engage a through-hole penetrating through each of the base 51, the resin layer 44, the absorber 43, and the like.

Each of the equalizer 41 and the absorber 42 is an independent part extending in a span corresponding to the light emission span H of the halogen heater 23. Contrarily, the base 51, the resin layer 44, and the absorber 43 constitute multiple parts divided in the axial direction of the fixing belt 21. As shown in FIG. 16, the length of the center base 51 in the axial direction of the fixing belt 21 is equivalent to the width, that is, a short side, of the A6 size sheet P in the axial direction of the fixing belt 21.

Although FIG. 16 illustrates the absorber 43 constituting the increased thermal conduction portion IP that is disposed outboard from the conveyance span on the fixing belt 21 where the sheet P is conveyed over the fixing belt 21 in the axial direction thereof, the absorber 43 may extend to the conveyance span on the fixing belt 21 where the sheet P is conveyed over the fixing belt 21 so that the increased thermal conduction portion IP including the absorber 43 is disposed opposite the overheating span of the fixing belt 21 including at least a part of the non-conveyance span on the fixing belt 21 where the sheet P is not conveyed over the fixing belt 21 and the contiguous span contiguous to the non-conveyance span in the axial direction of the fixing belt 21, that is, a part of the conveyance span on the fixing belt 21 where the sheet P is conveyed over the fixing belt 21.

Alternatively, as shown in FIGS. 9A to 9D, the equalizer 41 of the fixing device 20W may mount the bulge 45, 45T, or 45U projecting from the downstream end 41*a* of the equalizer 41 toward the pressure roller 22 and the low-friction sheet 59 coating the nip face of the equalizer 41 disposed opposite the fixing nip N. The configurations of the components that form the fixing nip N shown in FIGS. 9A to 9D, 10B, 11A, and 11B are also applicable to the fixing device 20W.

Typical Electricity Consumption (TEC) is an index of energy saving. The equalizer 41 may confront a trade-off between a TEC value and overheating of both lateral ends of the fixing belt 21 in the axial direction thereof. For example, if the equalizer 41 is excessively thin, it may not suppress overheating of both lateral ends of the fixing belt 21 in the axial direction thereof. Conversely, if the equalizer 41 is excessively thick, it may degrade the TEC value. To address this circumstance, the thickness of the equalizer 41 is in a range of from about 9 micrometers to about 3 mm.

Figure 17:
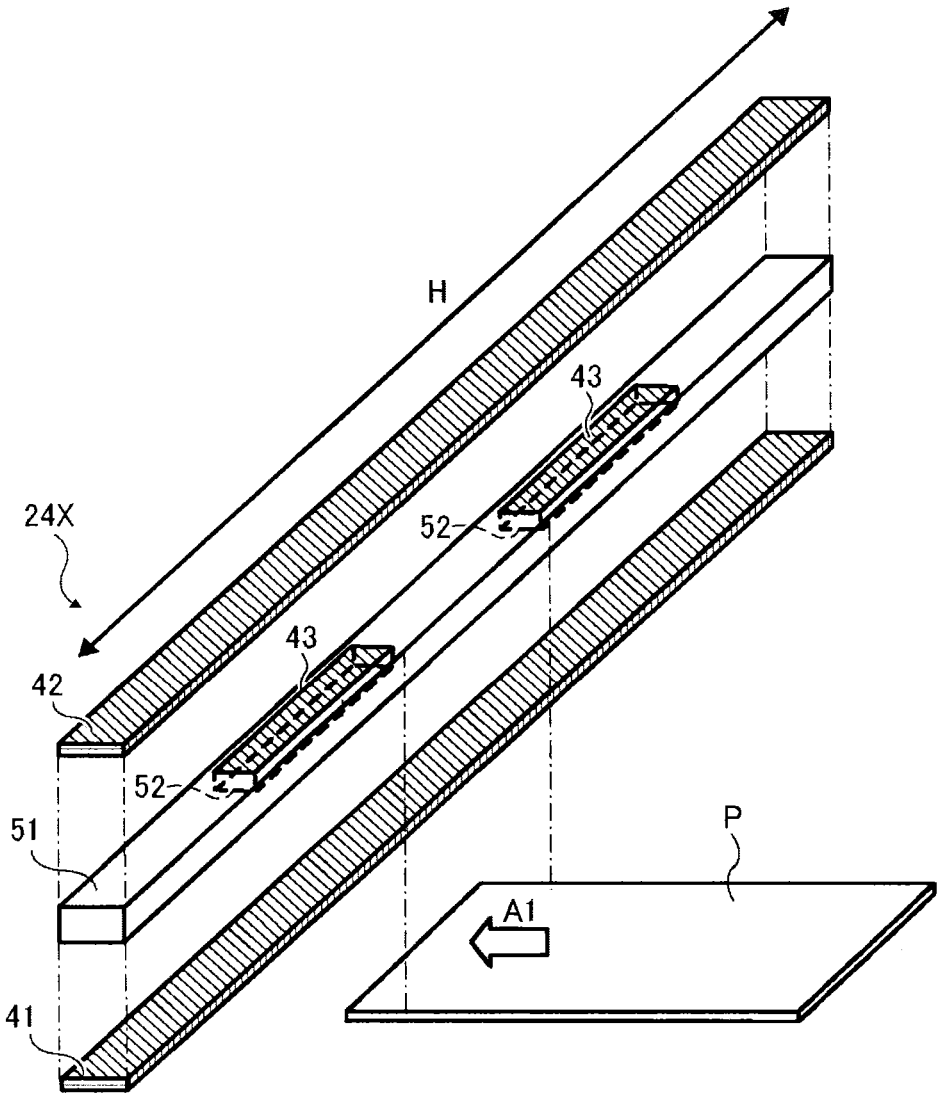
FIG. 17 is a schematic exploded perspective view of a nip formation pad as a first variation of the nip formation pad shown in FIG. 16.

With reference to FIG. 17, a description is provided of a construction of a nip formation pad 24X according to yet another exemplary embodiment.

FIG. 17 is a schematic exploded perspective view of the nip formation pad 24X. FIG. 17 illustrates an A6 size sheet P conveyed in the sheet conveyance direction A1. As shown in FIG. 17, like the nip formation pads 24V and 24W depicted in FIGS. 13A and 15A, respectively, the nip formation pad 24X includes the absorber 43 sandwiched between the equalizer 41 and the absorber 42 and extended in the axial direction of the fixing belt 21. The absorber 43 is embedded in a recess 52 produced in the base 51. Hence, the nip formation pad 24X includes the base 51, the recess 52, the equalizer 41, and the absorbers 42 and 43. The recess 52 does not penetrate through the base 51. The recess 52 is thinner than a portion of the base 51 where the recess 52 is not produced. The thickness of the recess 52 is changed to adjust an amount of heat conducted from the equalizer 41 to the absorber 42 through the absorber 43. Further, the length of the recess 52 in the sheet conveyance direction A1 is changed in accordance with an amount of heat to be absorbed by the absorber 43. For example, as the amount of heat to be absorbed by the absorber 43 increases, the length of the recess 52 in the sheet conveyance direction A1 increases. Conversely, as the amount of heat to be absorbed by the absorber 43 decreases, the length of the recess 52 in the sheet conveyance direction A1 decreases.

A face of the absorber 43 disposed opposite the absorber 42 is leveled with a face of the base 51 disposed opposite the absorber 42. Alternatively, the recess 52 may penetrate through the base 51 and may be equivalent in thickness to a portion of the base 51 where the recess 52 is not produced.

Although FIG. 17 illustrates the absorber 43 constituting the increased thermal conduction portion IP that is disposed outboard from the conveyance span on the fixing belt 21 where the sheet P is conveyed over the fixing belt 21 in the axial direction thereof, the absorber 43 may extend to the conveyance span on the fixing belt 21 where the sheet P is conveyed over the fixing belt 21 so that the increased thermal conduction portion IP including the absorber 43 is disposed opposite the overheating span of the fixing belt 21 including at least a part of the non-conveyance span on the fixing belt 21 where the sheet P is not conveyed over the fixing belt 21 and the contiguous span contiguous to the non-conveyance span in the axial direction of the fixing belt 21, that is, a part of the conveyance span on the fixing belt 21 where the sheet P is conveyed over the fixing belt 21.

With the construction of the nip formation pad 24X described above, the temperature TA of the non-conveyance span outboard from the conveyance span A on the fixing belt 21 in the axial direction thereof is suppressed to a temperature lower than the upper limit of target temperature UT of the fixing belt 21 and at the same time shortage of heat in the fixing belt 21 is reduced while saving power.

Figure 18:
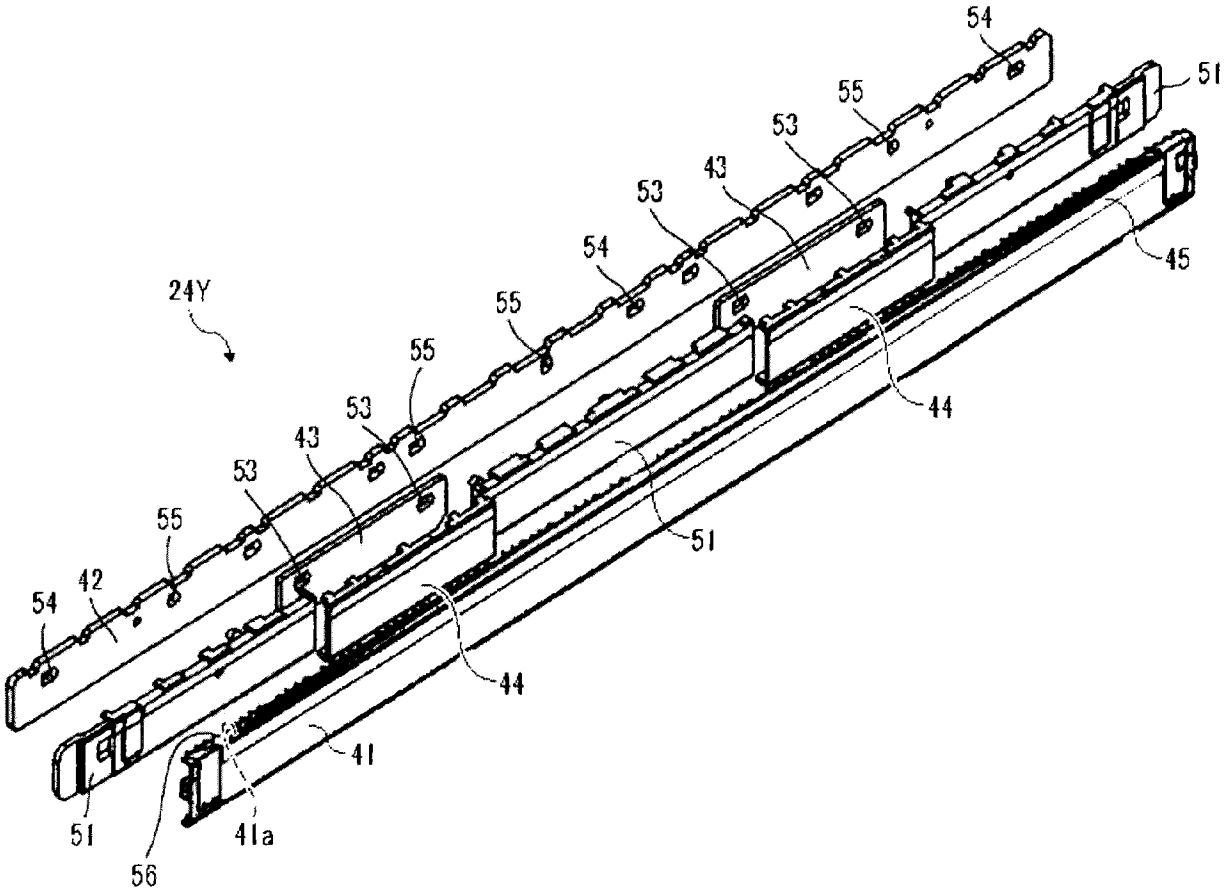
FIG. 18 is a schematic exploded perspective view of a nip formation pad as a second variation of the nip formation pad shown in FIG. 16 seen from a fixing nip of the fixing device shown in FIG. 14.
Figure 19:
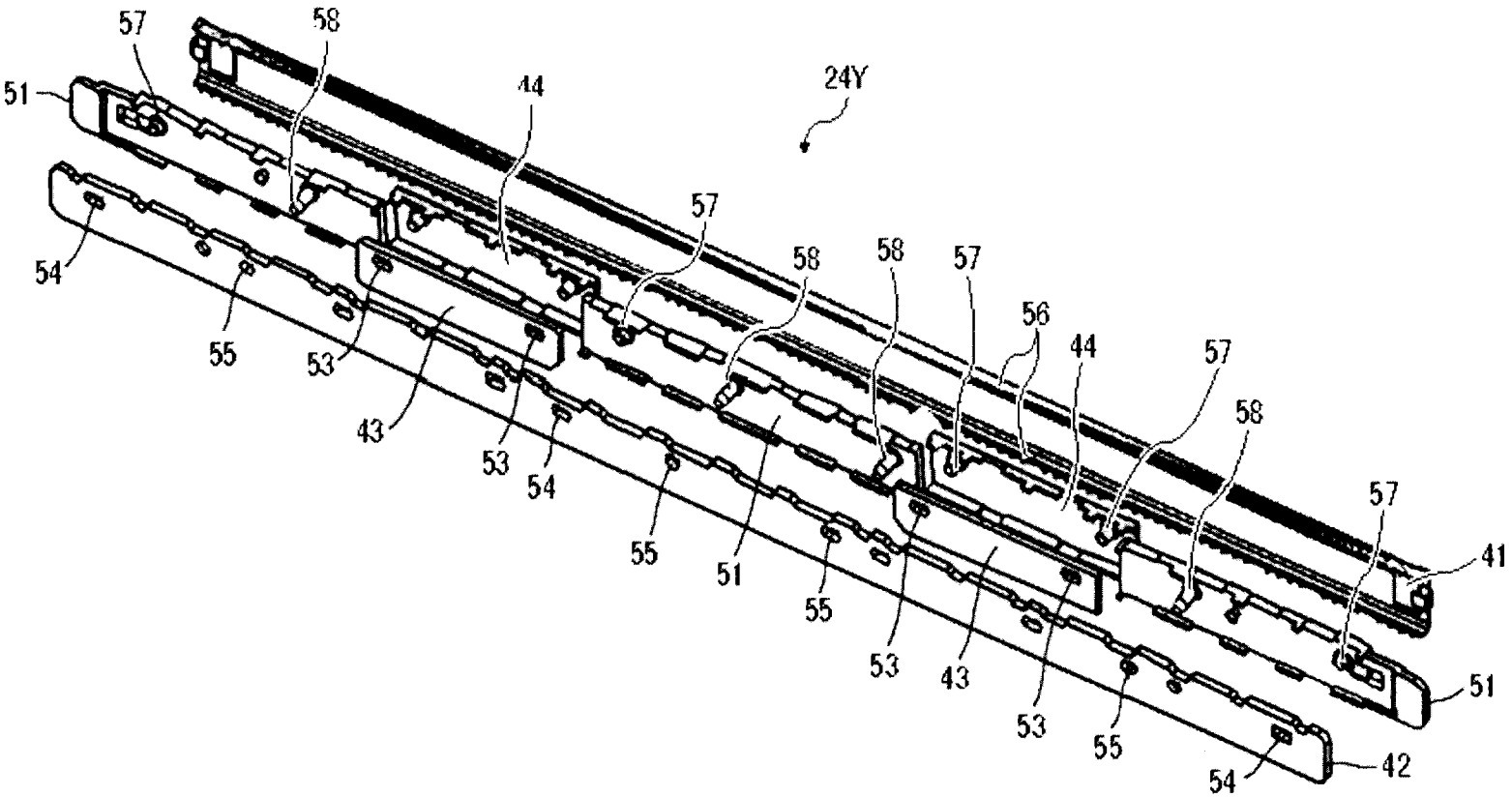
FIG. 19 is a schematic exploded perspective view of the nip formation pad shown in FIG. 18 seen from a stay incorporated in the fixing device shown in FIG. 14.

With reference to FIGS. 18 and 19, a description is provided of a construction of a nip formation pad 24Y according to yet another exemplary embodiment.

FIG. 18 is a schematic exploded perspective view of the nip formation pad 24Y seen from the fixing nip N shown in FIG. 14. FIG. 19 is a schematic exploded perspective view of the nip formation pad 24Y seen from the stay 25 shown in FIG. 14. The following describes mainly a construction of the nip formation pad 24Y peculiar to it.

As shown in FIG. 18, each lateral end of the equalizer 41 in the sheet conveyance direction A1 is bent to produce a rim projecting toward the absorber 42. Hence, the equalizer 41 is formed in a U-like shape in cross-section that accommodates the base 51, the resin layer 44, and the absorbers 42 and 43 that are layered on the equalizer 41. The rim of the equalizer 41 includes teeth 56. The teeth 56 are not continuously produced throughout the entire span of the equalizer 41 in the longitudinal direction thereof. For example, planar portions are aligned in the longitudinal direction of the equalizer 41 with a predetermined interval between the adjacent planar portions. The teeth 56 catch or engage the low-friction sheet 59 serving as a slide aid wound around an outer circumferential surface of the nip formation pad 24Y, preventing the low-friction sheet 59 from being displaced in accordance with rotation of the fixing belt 21. A jig used to attach the low-friction sheet 59 to the nip formation pad 24Y comes into contact with the planar portion of the equalizer 41.

As shown in FIG. 19, the teeth 56 are produced on the rim of the equalizer 41 at each lateral end thereof in the sheet conveyance direction A1. Alternatively, the teeth 56 may be produced at one lateral end of the equalizer 41 disposed opposite an entry to the fixing nip N in the sheet conveyance direction A1, that is, a lower end of the equalizer 41 in FIG. 19. Since the fixing belt 21 moves from the entry to the exit of the fixing nip N, if the teeth 56 situated at the entry to the fixing nip N catch the low-friction sheet 59 precisely, it may not be necessary to produce the teeth 56 at the exit of the fixing nip N.

As shown in FIG. 19, through-holes 54 serving as second through-holes and through-holes 55 serving as third through-holes penetrate through the absorber 42. Through-holes 53 serving as first through-holes penetrate through the absorber 43. Projections 58 serving as second projections projecting from an inner face of the base 51 toward the absorber 42 are inserted into the through-holes 55. Projections 57 serving as third projections projecting from the inner face of the base 51 toward the absorber 42 are inserted into the through-holes 54. Projections 57 serving as first projections projecting from an inner face of the resin layer 44 toward the absorbers 43 and 42 are inserted into the through-holes 53 and 54. The projection 57 projecting from the resin layer 44 is inserted into the through-hole 53 produced through the absorber 43 to hold the absorber 43. The projection 58 projecting from the base 51 is inserted into the through-hole 55 produced through the absorber 42 to hold the absorber 42. The projection 57 projecting from the base 51 is inserted into the through-hole 54 produced through the absorber 42 to hold the absorber 42. The projection 58 is longer than the projection 57 in a projection direction perpendicular to a longitudinal direction of the nip formation pad 24Y. Accordingly, the projection 58 penetrating through the through-hole 55 produced through the absorber 42 engages an engagement hole of the stay 25 depicted in FIG. 14, thus mounting the nip formation pad 24Y on the stay 25.

As shown in FIG. 18, the bulge 45 projects from the equalizer 41 toward the pressure roller 22 at the downstream end 41*a* thereof disposed opposite the exit of the fixing nip N. The equalizer 41 is made of a single copper plate that is planar from the entry to the exit of the fixing nip N, that is, vertically upward in FIG. 18, and curved at the exit of the fixing nip N to project toward the pressure roller 22 depicted in FIG. 14, producing the bulge 45.

According to the exemplary embodiments described above, the stationary equalizer 41 is mounted on the nip face of the base 51 pressing against the inner circumferential surface of the fixing belt 21. Accordingly, the equalizer 41 prevents overheating of both lateral ends of the fixing belt 21 in the axial direction thereof without a driver or a holder that moves the equalizer 41 to both lateral ends of the fixing belt 21 in the axial direction thereof. Additionally, the absorbers 42 and 43 adjust an amount of heat absorbed therein in a thickness direction of a nip formation pad (e.g., the nip formation pads 24, 24', 24S, 24T, 24U, 24V, 24W, 24X, and 24Y). The equalizer 41 conducts heat in the axial direction of the fixing belt 21 and the absorbers 42 and 43 absorb heat conducted from the fixing belt 21 through the equalizer 41, preventing overheating of the non-conveyance span produced at both lateral ends of the fixing belt 21 in the axial direction thereof and reducing energy consumption while preventing adverse effects such as an extended warm-up time to warm up the fixing belt 21 and shortage of heat in the fixing belt 21. As shown in FIGS. 9A to 9D, the bulge 45, 45T, or 45U projecting from the equalizer 41 at the downstream end 41*a* disposed opposite the exit of the fixing nip N produces the nip face of the equalizer 41 that facilitates separation of the sheet P from the fixing belt 21.

As shown in FIG. 11A, the low-friction sheet 59 interposed between the fixing belt 21 and the equalizer 41 facilitates sliding of the fixing belt 21 over the equalizer 41. As shown in FIG. 11B, the elastic layer 57 or conductive grease interposed between the rough low-friction sheet 59 and the rough equalizer 41 having surface asperities SA eliminates the air layer produced between the low-friction sheet 59 and the equalizer 41 and increases the area of an interface between the equalizer 41 and the low-friction sheet 59, facilitating conduction of heat from the low-friction sheet 59 to the equalizer 41 and thereby evening temperature distribution of the fixing belt 21.

A description is provided of advantages of the fixing devices 20, 20V, and 20W.

As shown in FIGS. 6, 12, and 14, a fixing device (e.g., the fixing devices 20, 20V, and 20W) includes a fixing rotator (e.g., the fixing belt 21) rotatable in the rotation direction R3; an opposed rotator (e.g., the pressure roller 22) disposed opposite the fixing rotator; a heater (e.g., the halogen heater 23) to heat the fixing rotator; a nip formation pad (e.g., the nip formation pads 24, 24', 24S, 24T, 24U, 24V, 24W, 24X, and 24Y) disposed opposite an inner circumferential surface of the fixing rotator; and a support (e.g., the stay 25) to support the nip formation pad. The opposed rotator is pressed against the nip formation pad via the fixing rotator to form the fixing nip N between the opposed rotator and the fixing rotator, through which a recording medium (e.g., a sheet P) bearing a toner image is conveyed. The nip formation pad includes a base (e.g., the base 51) and a first thermal conductor (e.g., the equalizer 41) having a thermal capacity or a thermal conductivity greater than that of the base and being sandwiched between the fixing rotator and the base. As shown in FIGS. 9A to 9D, a bulge (e.g., the bulges 45, 45T, and 45U) projects from the downstream end 41*a* of the first thermal conductor in a recording medium conveyance direction (e.g., the sheet conveyance direction A1) toward the opposed rotator. The downstream end 41*a* of the first thermal conductor is disposed opposite the exit of the fixing nip N in the recording medium conveyance direction.

The stationary first thermal conductor facilitates heat conduction. Accordingly, the fixing device prevents or suppresses overheating of both lateral ends of the fixing rotator in an axial direction thereof during a fixing operation to fix the toner image on the recording medium and reduces waste of energy while preventing adverse effects such as increased energy consumption, an extended warm-up time to warm up the fixing rotator, and shortage of heat in the fixing rotator. The first thermal conductor interposed between the fixing rotator and the base evens heat distribution of the fixing rotator and facilitates separation of the recording medium from the fixing rotator.

As shown in FIGS. 8B, 13B, and 15B, the conveyance spans A, B, C, and D where sheets P of various sizes are conveyed over the fixing belt 21 are centered in the axial direction of the fixing belt 21. Hence, the non-conveyance span of the fixing belt 21, outboard from each of the conveyance spans A, B, C, and D, where the sheets P are not conveyed over the fixing belt 21 is produced at each lateral end of the fixing belt 21 in the axial direction thereof. Alternatively, the conveyance spans A, B, C, and D may be defined along one lateral edge of the fixing belt 21 in the axial direction thereof and the non-conveyance span of the fixing belt 21 may be defined along another lateral edge of the fixing belt 21 in the axial direction thereof.

According to the exemplary embodiments described above, the fixing belt 21 serves as a fixing rotator. Alternatively, a fixing film, a fixing roller, or the like may be used as a fixing rotator. Further, the pressure roller 22 serves as an opposed rotator. Alternatively, a pressure belt or the like may be used as an opposed rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator rotatable in a predetermined direction of rotation;

an opposed rotator disposed opposite the fixing rotator to form a fixing nip therebetween through which a recording medium bearing a toner image is conveyed;

a heater disposed opposite the fixing rotator to heat the fixing rotator; and a nip formation pad disposed opposite an inner circumferential surface of the fixing rotator, the nip formation pad including:

a base;

a first thermal conductor sandwiched between the base and the fixing rotator, the first thermal conductor having a first thermal conductivity greater than a thermal conductivity of the base, and the first thermal conductor includes:

an upstream arm; and a downstream arm to sandwich the base together with the upstream arm in a recording medium conveyance direction; and a bulge projecting from the first thermal conductor toward the opposed rotator at a downstream end of the first thermal conductor in the recording medium conveyance direction.

2. The fixing device according to claim 1, wherein the bulge is disposed opposite an exit of the fixing nip in the recording medium conveyance direction.

3. The fixing device according to claim 1, wherein a modulus of elasticity of the first thermal conductor is smaller than a modulus of elasticity of the base.

4. The fixing device according to claim 1, wherein the first thermal conductor is made of copper.

5. The fixing device according to claim 1, further comprising a slide aid sandwiched between the fixing rotator and the first thermal conductor of the nip formation pad.

6. The fixing device according to claim 5, further comprising an elastic layer sandwiched between the slide aid and the first thermal conductor of the nip formation pad.

7. The fixing device according to claim 6, wherein the elastic layer includes conductive tape.

8. The fixing device according to claim 5, wherein conductive grease is applied between the slide aid and the first thermal conductor.

9. The fixing device according to claim 5, wherein the nip formation pad further includes a stopper projecting from the first thermal conductor in a direction opposite a direction in which the bulge projects from the first thermal conductor at the downstream end of the first thermal conductor along a downstream face of the base.

10. The fixing device according to claim 9, wherein the stopper and the base nip the slide aid.

11. The fixing device according to claim 1, wherein the first thermal conductor has a thickness in a range of from about 9 micrometers to about 3 mm.

12. The fixing device according to claim 1, wherein the nip formation pad further includes:

a decreased thermal conduction portion having a decreased thermal conductivity to conduct heat in a thickness direction of the nip formation pad perpendicular to an axial direction of the fixing rotator; and an increased thermal conduction portion having an increased thermal conductivity to conduct heat in the thickness direction of the nip formation pad, the increased thermal conduction portion disposed opposite an overheating span of the fixing rotator in the axial direction thereof where the fixing rotator is susceptible to overheating.

13. The fixing device according to claim 12, wherein the increased thermal conduction portion of the nip formation pad includes:

the first thermal conductor; and a second thermal conductor, having a second thermal conductivity greater than the thermal conductivity of the base, disposed opposite the fixing rotator via the first thermal conductor.

14. The fixing device according to claim 13, wherein the second thermal conductor is disposed opposite the overheating span of the fixing rotator.

15. The fixing device according to claim 13, wherein the nip formation pad further includes a resin layer sandwiched between the first thermal conductor and the second thermal conductor, the resin layer having a thermal conductivity smaller than the second thermal conductivity of the second thermal conductor.

16. The fixing device according to claim 13, wherein the nip formation pad further includes a third thermal conductor, having a third thermal conductivity greater than the thermal conductivity of the base, contacting the second thermal conductor.

17. The fixing device according to claim 16, wherein each of the second thermal conductor and the third thermal conductor is made of metal.

18. The fixing device according to claim 13, further comprising a support contacting and supporting the nip formation pad, the support contacting the second thermal conductor.

19. The fixing device according to claim 18, wherein each of the second thermal conductor and the support is made of metal.

20. The fixing device according to claim 1, further comprising a support to support the nip formation pad.

21. The fixing device according to claim 20, wherein the support is not sandwiched between the upstream arm and the downstream arm of the first thermal conductor.

22. A fixing device comprising:

a fixing rotator rotatable in a predetermined direction of rotation;

an opposed rotator disposed opposite the fixing rotator to form a fixing nip therebetween through which a recording medium bearing a toner image is conveyed;

a heater disposed opposite the fixing rotator to heat the fixing rotator;

a nip formation pad disposed opposite an inner circumferential surface of the fixing rotator, the nip formation pad including:

a base;

a first thermal conductor sandwiched between the base and the fixing rotator, the first thermal conductor having a first thermal conductivity greater than a thermal conductivity of the base; and a bulge projecting from the first thermal conductor toward the opposed rotator at a downstream end of the first thermal conductor in a recording medium conveyance direction; and a slide aid sandwiched between the fixing rotator and the first thermal conductor of the nip formation pad, wherein the nip formation pad further includes a stopper projecting from the first thermal conductor in a direction opposite a direction in which the bulge projects from the first thermal conductor at the downstream end of the first thermal conductor along a downstream face of the base, and the stopper and the base nip the slide aid.

23. A fixing device comprising:

a fixing rotator rotatable in a predetermined direction of rotation;

an opposed rotator disposed opposite the fixing rotator to form a fixing nip therebetween through which a recording medium bearing a toner image is conveyed;

a heater disposed opposite the fixing rotator to heat the fixing rotator; and a nip formation pad disposed opposite an inner circumferential surface of the fixing rotator, the nip formation pad including:

a base;

a first thermal conductor sandwiched between the base and the fixing rotator, the first thermal conductor having a first thermal conductivity greater than a thermal conductivity of the base;

a bulge projecting from the first thermal conductor toward the opposed rotator at a downstream end of the first thermal conductor in a recording medium conveyance direction;

a decreased thermal conduction portion having a decreased thermal conductivity to conduct heat in a thickness direction of the nip formation pad perpendicular to an axial direction of the fixing rotator; and an increased thermal conduction portion having an increased thermal conductivity to conduct heat in the thickness direction of the nip formation pad, the increased thermal conduction portion disposed opposite an overheating span of the fixing rotator in the axial direction thereof where the fixing rotator is susceptible to overheating, wherein the increased thermal conduction portion of the nip formation pad includes:

the first thermal conductor; and a second thermal conductor, having a second thermal conductivity greater than the thermal conductivity of the base, disposed opposite the fixing rotator via the first thermal conductor.

24. The fixing device according to claim 23, wherein the second thermal conductor is disposed opposite the overheating span of the fixing rotator.

25. The fixing device according to claim 23, wherein the nip formation pad further includes a resin layer sandwiched between the first thermal conductor and the second thermal conductor, the resin layer having a thermal conductivity smaller than the second thermal conductivity of the second thermal conductor.

26. The fixing device according to claim 23, wherein the nip formation pad further includes a third thermal conductor, having a third thermal conductivity greater than the thermal conductivity of the base, contacting the second thermal conductor.

27. The fixing device according to claim 26, wherein each of the second thermal conductor and the third thermal conductor is made of metal.

28. The fixing device according to claim 23, further comprising a support contacting and supporting the nip formation pad, the support contacting the second thermal conductor.

29. The fixing device according to claim 28, wherein each of the second thermal conductor and the support is made of metal.

30. An image forming apparatus comprising the fixing device according to claim 1.

31. The fixing device according to claim 1, wherein the bulge is integral with the first thermal conductor and includes the first thermal conductivity that is greater than the thermal conductivity of the base, and the bulge projects from the first thermal conductor without being produced by a pressure on the first thermal conductor.

* * * * *